US010689840B2

(12) United States Patent
Bonlin

(10) Patent No.: US 10,689,840 B2
(45) Date of Patent: Jun. 23, 2020

(54) MODULAR BEAM STRUCTURE AND MODULAR BASE STRUCTURE

(71) Applicant: RBON HOLDINGS PTY LTD, Victoria (AU)

(72) Inventor: Rodney Peter Bonlin, Victoria (AU)

(73) Assignee: RBON HOLDINGS PTY LTD, Melbourne (AU)

( * ) Notice: Subject to any disclaimer, the term of this patent is extended or adjusted under 35 U.S.C. 154(b) by 0 days.

(21) Appl. No.: 16/097,391

(22) PCT Filed: May 1, 2017

(86) PCT No.: PCT/AU2017/000109
§ 371 (c)(1),
(2) Date: Oct. 29, 2018

(87) PCT Pub. No.: WO2017/185125
PCT Pub. Date: Nov. 2, 2017

(65) Prior Publication Data

US 2019/0153720 A1 May 23, 2019

(30) Foreign Application Priority Data

Apr. 29, 2016 (AU) ..... 2016901574

(51) Int. Cl.
*E04B 1/343* (2006.01)
*E04B 1/348* (2006.01)
(Continued)

(52) U.S. Cl.
CPC ..... *E04B 1/34331* (2013.01); *E04B 1/3483* (2013.01); *E04B 1/34815* (2013.01);
(Continued)

(58) Field of Classification Search
CPC .. E04B 1/343; E04B 1/34331; E04B 1/34815; E04B 1/3483; E04B 1/40;
(Continued)

(56) References Cited

U.S. PATENT DOCUMENTS 3,966,285 A * 6/1976 Porch ..... B65D 7/24 312/265.4
4,077,170 A * 3/1978 van der Lely ..... E04B 1/34853 52/263
(Continued)

FOREIGN PATENT DOCUMENTS

EP 2468984 A1 6/2012
FR 2891810 A1 4/2007
(Continued)

OTHER PUBLICATIONS

International Search Report, dated Aug. 21, 2017, from corresponding PCT/AU2017/000109 application.

*Primary Examiner* — James M Ference
(74) *Attorney, Agent, or Firm* — Young & Thompson

(57) ABSTRACT

A building structure assembly includes standardized interlocking components sized to suit any particular size of building required and ISO standard shipping containers, including: at least one modular base structure, at least one modular beam structure, and at least one wall support in the form of a shipping container and a method of assembly of the building structure. Each modular beam and base structures a frame, interlocking with each other and a shipping container by corner castings with twist lock assemblies, arranged in a particular orientation with each other. The modular base structure is supported by the corner castings of a shipping container and the base structure supports an end portion of at least one modular beam structure. A modular beam structure spans shipping containers. The modular
(Continued)

Figures 1, 2, 3, 4:
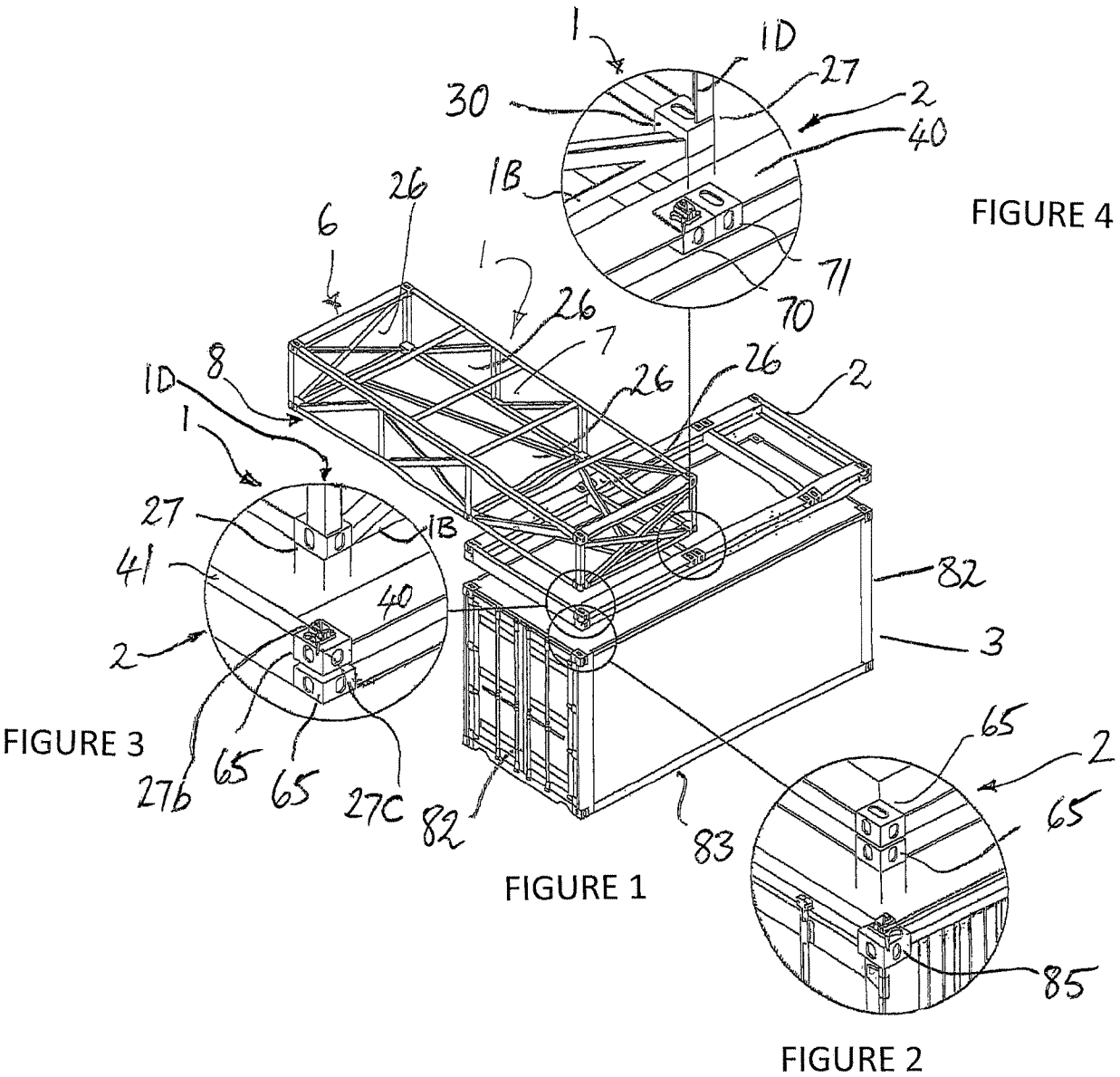
Figure 2:
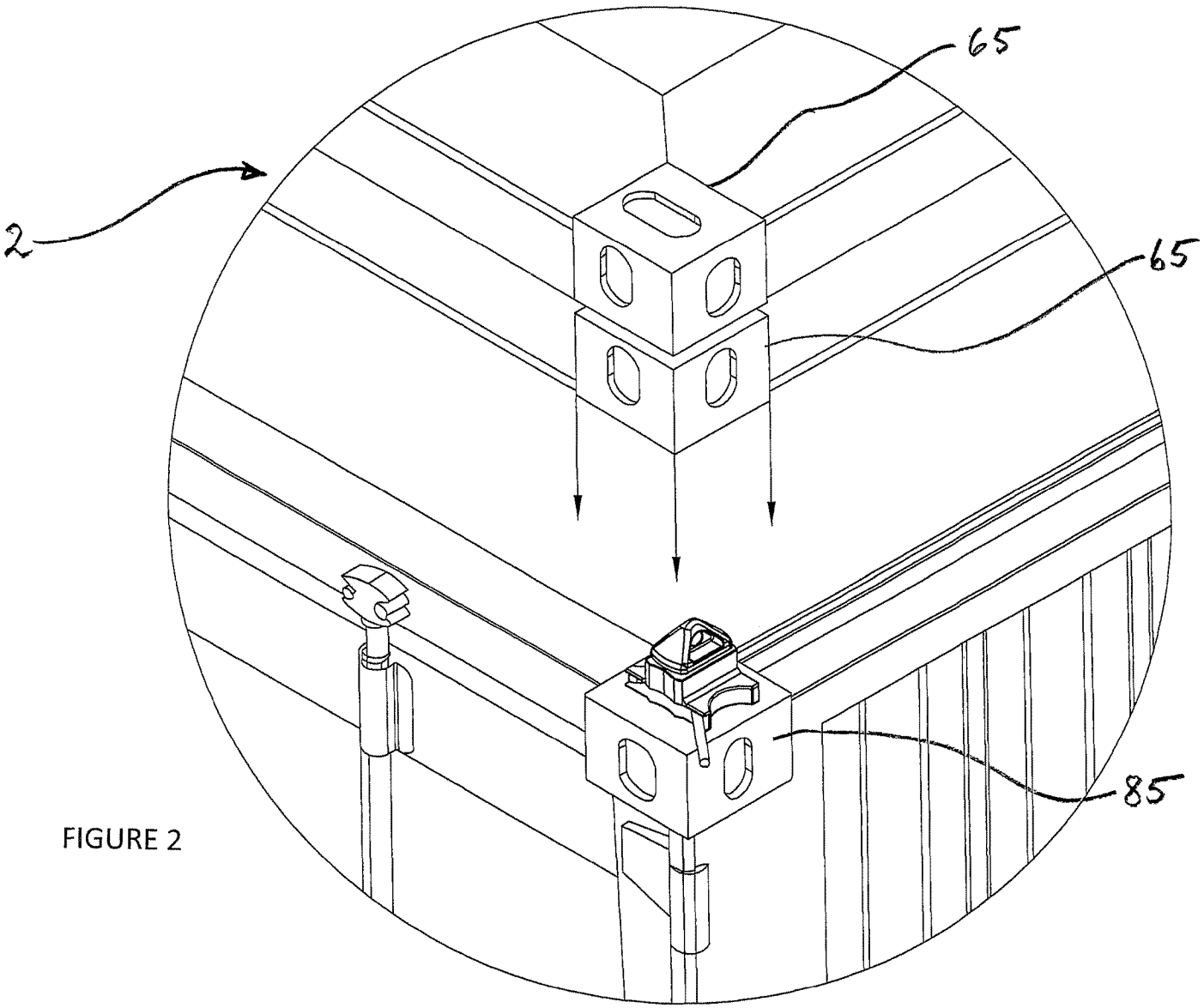
Figure 3:
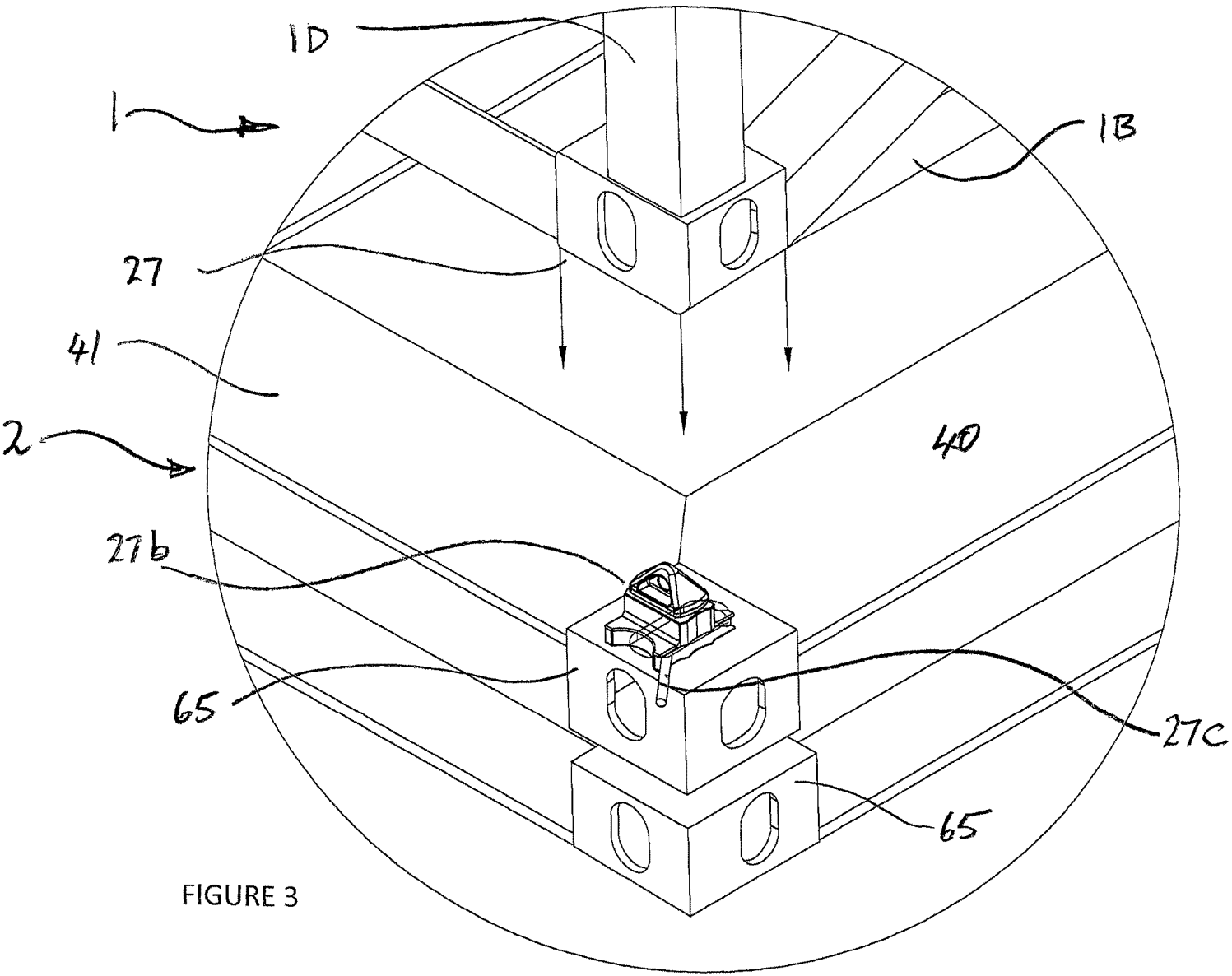
Figure 4:
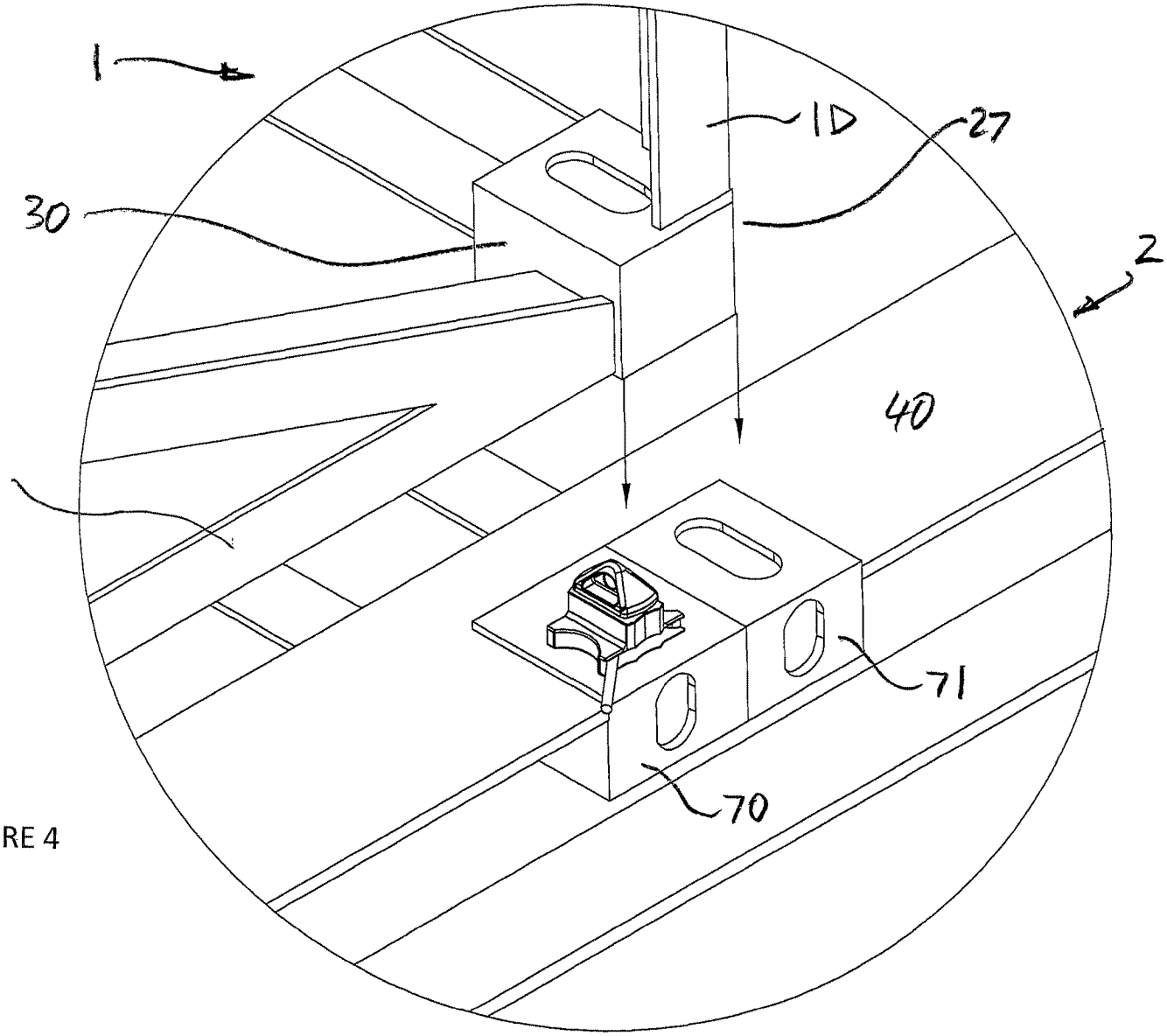

beam structures can function as roof trusses and are sized to be transported inside shipping containers.

14 Claims, 35 Drawing Sheets

(51) Int. Cl.

| | |
|---|---|
| ***E04B 1/41*** | (2006.01) |
| ***E04B 2/56*** | (2006.01) |
| ***E04C 3/04*** | (2006.01) |
| ***E04G 21/14*** | (2006.01) |
| *E04B 1/58* | (2006.01) |
| *E04B 1/38* | (2006.01) |

(52) U.S. Cl.
CPC ..... *E04B 1/40* (2013.01); *E04B 2/56* (2013.01); *E04C 3/04* (2013.01); *E04G 21/14* (2013.01); *E04B 1/343* (2013.01); *E04B 1/5812* (2013.01); *E04B 2001/405* (2013.01); *E04C 2003/0486* (2013.01)

(58) Field of Classification Search
CPC .... E04B 1/5812; E04B 2/56; E04B 2001/405; E04B 2001/34884; E04C 3/04; E04C 2003/0486; E04G 21/14; E04H 1/005; E04H 1/02; E04H 1/06; E04H 1/1205; E04H 2001/1283
See application file for complete search history.

(56) References Cited

U.S. PATENT DOCUMENTS 4,378,664 A * 4/1983 Andaya ..... E04B 1/21 52/742.15
4,416,385 A * 11/1983 Clare ..... B65D 88/129 108/55.1
4,422,558 A * 12/1983 Mittelmann ..... B65D 88/528 220/1.5
4,545,158 A * 10/1985 Rizk ..... E04B 1/3483 52/238.1
4,545,159 A * 10/1985 Rizk ..... E04B 1/3483 52/143
4,599,829 A * 7/1986 DiMartino, Sr. ..... E04B 1/3483 410/79
4,620,404 A * 11/1986 Rizk ..... E04B 1/3483 52/235
4,833,841 A * 5/1989 Ellington, III ..... E04B 1/3483 52/143
5,966,956 A * 10/1999 Morris ..... F25D 11/003 52/69
6,088,970 A * 7/2000 Doran ..... E04B 1/12 52/241
6,179,522 B1 * 1/2001 Sanford ..... B09B 3/00 405/129.55
6,253,521 B1 * 7/2001 Gavin ..... E04B 1/24 52/481.1
6,651,393 B2 * 11/2003 Don ..... E04B 1/3483 52/124.2
6,951,079 B2 * 10/2005 Weiss ..... E04B 1/14 52/122.1
6,959,514 B1 * 11/2005 Pingel ..... E04B 1/3483 52/79.1
7,310,914 B1 * 12/2007 Moore ..... E04B 1/3483 52/289
8,091,291 B2 * 1/2012 Ode ..... A01G 9/14 52/643
8,186,110 B2 * 5/2012 Green ..... E04B 1/24 52/79.9
8,800,238 B2 * 8/2014 Davies ..... E04B 7/022 52/641
2002/0129566 A1 * 9/2002 Piccolo ..... E04B 1/3483 52/79.1
2005/0210762 A1 * 9/2005 Broberg ..... E04B 1/34807 52/79.1
2006/0207193 A1 * 9/2006 Lilke ..... E04B 1/3483 52/79.7
2007/0000921 A1 * 1/2007 Butler ..... B65D 88/121 220/1.5
2007/0163184 A1 * 7/2007 Olesch ..... E04B 1/34838 52/79.5
2007/0271857 A1 * 11/2007 Heather ..... B65D 88/005 52/79.9
2008/0053017 A1 * 3/2008 Hockemeyer ..... E04B 7/022 52/263
2008/0053018 A1 * 3/2008 Hockemeyer ..... E04H 1/1205 52/263
2008/0134589 A1 * 6/2008 Abrams ..... E04B 1/003 52/79.1
2009/0188928 A1 * 7/2009 Wolf ..... B65D 19/38 220/694
2009/0307994 A1 * 12/2009 Cathcart ..... E04B 1/3483 52/79.9
2010/0024318 A1 * 2/2010 Zhang ..... E04B 7/022 52/79.5
2011/0023387 A1 * 2/2011 Sweeney ..... E04H 9/021 52/167.4
2011/0036018 A1 * 2/2011 Hsu ..... E04B 1/3483 52/2.19
2011/0056147 A1 * 3/2011 Beaudet ..... E04B 1/3483 52/79.9
2011/0259768 A1 * 10/2011 Campbell ..... E04B 1/3444 206/216
2011/0289860 A1 * 12/2011 Wilson ..... E04B 1/34315 52/79.5
2014/0008359 A1 * 1/2014 Ferren ..... E04H 3/08 220/1.5
2014/0298745 A1 * 10/2014 Rechenmacher ..... E04B 1/161 52/425
2014/0325931 A1 * 11/2014 Prodaniuk ..... E04H 1/12 52/656.9
2015/0152634 A1 * 6/2015 Unger ..... E04B 1/3483 52/79.2
2015/0240474 A1 * 8/2015 Kokoschka ..... F02B 63/044 52/79.1
2016/0017609 A1 * 1/2016 Bottin ..... E04D 13/04 52/302.1
2016/0130795 A1 * 5/2016 Downey ..... E04H 5/00 52/79.1
2019/0153720 A1 * 5/2019 Bonlin ..... E04B 1/40

FOREIGN PATENT DOCUMENTS

WO 2010/128458 A1 11/2010
WO 2014/078903 A1 5/2014

* cited by examiner

MODULAR BEAM STRUCTURE AND MODULAR BASE STRUCTURE

FIELD OF THE INVENTION

This invention relates to a modular base structure and modular beam structure, and in particular, but not exclusively to modular base structures or modular beam structures for use with or as buildings or structures which incorporate shipping containers and/or shipping container sized components and to an assembly method.

BACKGROUND OF THE INVENTION

There is often a need to construct temporary structures, for example, storage warehouses, workshops, offices or even living accommodation, and increasingly shipping containers, or shipping container sized modules are attempted to be used in these situations.

Shipping containers, and in particular used shipping containers, provide a relatively low cost structural component that are large and strong enough to form a work or dwelling space by itself, and/or to form a structural support for a larger building.

When shipping containers are used by themselves, or perhaps as a series of containers positioned side by side, one of the problems is the lack of insulation, particularly in the roof of the containers. This leads to a number of problems. The interior can heat up during the day, and then become very cold at night. When used for storage, this can lead to sweating of the stored goods when the temperatures are high, followed by condensation of the moisture when the temperature drops. The condensation can produce droplets that rain down, or drain onto the stored goods which can cause damage and extra cost.

When shipping containers are used as structural supports for larger buildings, for example to form a warehouse, an emergency medical center, a workshop or hangar, there is a need for additional structure to form a roof for the building. The construction of the roof section can be extremely difficult and time consuming, and it can be difficult to transport the required building materials. In cases where the building needs to be erected in a very short time, for example when providing a building in an emergency relief situation, it is important that such transportation and construction difficulties are minimized.

Other problems occur because of the multitude of variations of heights, widths, length containers especially when comparing each side of a building which form the wall which need to be of similar height to allow a roof section to span there between and be level. This problem of different heights or length containers cause some containers to not be able to be used which can further limit the usefulness of all containers as being readily available as part of a building structure. Shipping containers have corner castings with twist lock assemblies which also vary in size and position on the corners thereby preventing any standard methods of using them with other components of a building other than just connecting to the top of the container which does not provide a standard robust and predictable jointing system that can be relied upon structurally and practically and also does not allow for ready construction or assembly or disassembly.

In this specification unless the contrary is expressly stated, where a document, act or item of knowledge is referred to or discussed, this reference or discussion is not an admission that the document, act or item of knowledge or any combination thereof was at the priority date, publicly available, known to the public, part of common general knowledge; or known to be relevant to an attempt to solve any problem with which this specification is concerned.

SUMMARY OF THE INVENTION

It is therefore an object of the present invention to provide a modular base structure and modular beam structure for building a structure and method of assembly constructing a building utilizing at least one of the modular base and or beam structure which will at least go some way towards overcoming one or more of the above mentioned problems, or at least provide the public with a useful choice.

Accordingly, in a first aspect, the invention consist of a modular beam structure which is adapted to span a distance between and connect to a structural support which includes a shipping container having end walls defining a length, side walls defining a width and a roof and floor defining a height or a wall support, the modular beam structure includes a lattice space truss frame structure made up of elongate members forming an elongate box like framed rectangular structure with several box-like cells with corners, the rectangular structure comprising longitudinal beam members, transverse cross beam members and diagonal beam members connected together, corner castings located at each corner and non-corner castings located between each corner with each corner casting and non-corner including suitably sized and oriented slot apertures for locking and receipt of part of a twist lock assembly as provided by the shipping container or wall support wherein the rectangular structure includes an angled top portion and level bottom portion wherein the longitudinal beam members define a length and the transverse beams define a width such that the length and width of the rectangular structure is a multiple of the length of the shipping container to enable end support of the corner castings and non-corner castings on a shipping container or wall support and the modular beam structures being shaped and dimensioned to be able to be assembled on top of each other creating a shipping container size allowing transport within shipping containers.

Preferably the cross section of the elongate members is an L shaped member.

Preferably there are three box like cells.

Preferably the or each modular beam structure is configured as at least part of a roofing beam.

Preferably the or each modular beam structure is configured to form half the length of a roofing beam and is configured to mate with a similarly configured modular beam structure to form a complete roofing beam.

Preferably the or each modular beam structure is in the form of a trussed beam.

Preferably the or each modular beam structure has a first height at a first end, which is greater than a second height of the opposite or second end.

Preferably the combined height of the first height of a first beam, and the second height of a similarly configured second beam, is substantially equivalent to a standard shipping container height.

Preferably two similarly configured modular beam structure are configured such that a first modular beam structure can be laid upside down on a second modular beam structure, and to be fastened together, to form a shipping container sized unit.

Preferably the or each modular beam structure has a maximum width of 2438 mm, and more preferably the or each modular beam structure has a maximum width of 2430 mm.

Preferably the modular beam structure or plurality of modular beam structures form a modular beam set or components of a modular beam set.

Preferably the modular beam structure has a length commensurate with the length of 20 ft (6096 mm) or 40 ft (12,192 mm) shipping container.

Preferably the or each modular beam structure includes a water resistant surface configured to form an exterior roofing layer when the or each structural beam is used to form a part of a structure.

Accordingly, in a second aspect, the invention may broadly be said to consist in a modular base structure which provides a base for connection and support to a top of a structural support which includes a shipping container having end walls defining a length, side walls defining a width and a roof and floor defining a height or wall support, for connection of at least one end portion of a modular beam structure without loading the walls of the structural support, the modular base structure having a length, width and height, the modular base structure including an elongate lattice space frame structure forming a single planar like rectangular structure having the following faces of: end faces, top face, bottom face, front side edge face and rear side edge face, the rectangular structure comprising longitudinal beam members and transverse cross beam members connected together, the planar like structure formed from elongate members with corners and intersections between the elongate members, and having upper and lower corner castings located at each corner whereby the upper corner casting includes a twist lock assembly therein for locking connection to another corner casting of a modular beam structure and the lower corner castings having slot apertures for locking and receipt of a twist lock assembly of the shipping container or wall support, the space frame structure including interconnecting longitudinal beam members and transverse beam members forming cells there between whereby the transverse beam members intersect with the longitudinal beam members and include non-corner upper castings having twist lock assembly in an upper portion for locking receipt in slotted apertures of other corner castings of another modular beam structure and the distance between the corner and intersection or between the intersection to another intersection being dimensioned to receive and connect a width of the other modular beam structure, wherein the longitudinal beam members define a length and the transverse beams define a width such that the length and width of the rectangular structure is at least a multiple or complete length of the length of the shipping container or wall support.

Preferably the modular base structure includes three cells with four transverse cross beam members between the longitudinal beam members.

Alternatively, the modular base structure includes six cells with four transverse cross beam members between the longitudinal beam members.

Preferably the modular base structure includes at least two spaced longitudinal beam members connected with four spaced transverse cross beam members wherein the spacing of the transverse cross beam members is a precise portion length of the length of the wall support.

Preferably the modular base structure includes three spaced longitudinal beam members connected with seven spaced transverse cross beam members wherein the spacing of the transverse cross beam members is a precise portion length of the length of the wall support.

Preferably the longitudinal beam members comprise an I beam cross section.

Preferably the transverse cross beam members comprises an I beam cross section.

Alternatively the transverse cross beam members comprises a channel cross section.

Preferably the modular base structure has a depth dimension defined as extending from an in use upper horizontal plane to the lower horizontal plane of two upper and lower corner castings and allows for the upward protrusion of the casting of a shipping container to cause the modular beam structure to make up the difference in height between a short and tall shipping containers.

Accordingly, in a third aspect, the invention consists of a building structure assembly comprising the following components of at least one modular beam structure, at least one modular base structure and structural support as provided a shipping container having end walls defining a length, side walls defining a width and a roof and floor defining a height and wall support, wherein the modular base structure is supported by the wall support and the modular base structure supports an end portion of at least one modular beam structure and the modular beam structure spans a distance between spaced wall supports to enable end support of the corner castings and non-corner castings on a shipping container wall support and the modular beams structures being shaped and dimensioned to be able to be assembled on top of each other creating a shipping container size allowing transport within shipping containers, wherein each modular beam structure spans a distance between and connects to the shipper containers or wall supports wherein the shipping container includes a shipping container having end walls defining a length, side walls defining a width and a roof and floor defining a height, the modular beam structure including a lattice space truss frame structure made up of elongate members forming an elongate box like framed rectangular structure with several box-like cells with corners, the rectangular structure comprising longitudinal beam members, transverse cross beam members and diagonal beam members connected together, corner castings located at each corner and non-corner castings located between each corner with each corner casting and non-corner including suitably sized and oriented slot apertures for locking and receipt of part of a twist lock assembly as provided by the shipping container or wall support wherein the rectangular structure includes an angled top portion and level bottom portion wherein the longitudinal beam members define a length and the transverse beams define a width such that the length and width of the rectangular structure is a multiple of the length of the shipping container to enable end support of the corner castings and non-corner castings of a shipping container or wall support, wherein the modular base structure provides a base connected and supported to a top of a structural support which includes a shipping container or wall support, for connection of at least one end portion of a modular beam structure without loading the walls of the shipping container or wall support, the modular base structure having a length, width and height, the modular base structure including an elongate lattice space frame structure forming a single planar like rectangular structure having the following faces of: end faces, top face, bottom face, front side edge face and rear side edge face, the rectangular structure comprising longitudinal beam members and transverse cross beam members connected together, the planar like structure formed from elongate members with corners and intersections between the elongate members, and having upper and lower corner castings located at each corner whereby the upper corner casting includes a twist lock assembly therein for adjustable connection to another corner casting of a modular beam structure and the lower corner castings having slot apertures for locking and receipt of a twist lock assemblies of the shipping container or wall support, the space frame structure including interconnecting longitudinal beam members and transverse beam members forming cells there between whereby the transverse beam members intersect with the longitudinal beam members and include non-corner upper castings having twist lock assembly in an upper portion for locking receipt in slotted aperture of another corner casting of another modular beam structure and the distance between the corner and intersection or between the intersection to another intersection being dimensioned to receive and connect a width of the other modular beam structure, wherein the longitudinal beam members define a length and the transverse beams define a width such that the length and width of the rectangular structure is at least a multiple or complete length of the length of the shipping container or wall support, wherein the modular beam member spans between the shipping container and a wall support by being connectively supported at each end and at, at least one end by one modular base structure connected to the top the shipping container which functions as a wall support for the modular base structure and at an end of the modular beam structure whereby the components of the present invention are standardized in shape and structure to allow assembly and disassembly in relation to any sized shipping container and also transportation, using the shipping containers to carry most or at least part of the components of the building structure assembly.

Preferably the cross section of the elongate members of the modular beam structure is an L shaped member.

Preferably there are three box like cells.

Preferably the structural support is at least one shipping container spaced from another shipping container.

Alternatively the structural support includes a wall support comprising a frame including at least two posts with corner castings with twist lock assemblies affixed to a top of each post where the posts are interconnected with cross bracing members.

Preferably the modular base structure includes five cells with four transverse beam members between the longitudinal beam members.

Preferably the transverse cross beam members of the modular base structure have a channel cross section.

Preferably the or each modular beam structure is configured as a roofing beam, or as a part of a roofing beam.

Preferably the or each modular beam structure is configured to form half the length of a roofing beam and is configured to mate with a similarly configured structural beam to form a complete roofing beam.

Preferably the or each modular beam structure is in the form of a trussed beam.

Preferably the or each modular beam structure has a first height at a first end, which is greater than a second height of the opposite or second end.

Preferably the combined height of the first height of a first beam, and the second height of a similarly configured second beam, is substantially equivalent to a standard shipping container height.

Preferably two similarly configured modular beam structures are configured such that a first modular beam structure can be laid upside down on a second modular beam structure, and to be fastened together, to form a shipping container sized unit.

Preferably the or each modular beam structure has a maximum width of 2438 mm, and more preferably the or each modular beam structure has a maximum width of 2430 mm.

Preferably the modular beam structure or plurality of modular beam structures form a modular beam set or components of a modular beam set.

Preferably the modular beam structure has a length commensurate with the length of 20 ft (6096 mm) or 40 ft (12,192 mm) shipping container.

Preferably the or each modular beam structure includes a water resistant surface configured to form an exterior roofing layer when the or each structural beam is used to form a part of a structure.

Preferably the modular base structure includes three cells with four transverse cross beam members between the longitudinal beam members.

Alternatively, the modular base structure includes six cells with four transverse cross beam members between the longitudinal beam members.

Preferably the modular base structure includes at least two spaced longitudinal beam members connected with four spaced transverse cross beam members wherein the spacing of the transverse cross beam members is a precise portion length of the length of the wall support.

Preferably the modular base structure includes three spaced longitudinal beam members connected with seven spaced transverse cross beam members wherein the spacing of the transverse cross beam members is a precise portion length of the length of the wall support.

Preferably the longitudinal beam members comprise an I-beam cross section.

Preferably the transverse cross beam members comprises an I-beam cross section.

Alternatively the transverse cross beam members comprises a channel cross section.

Preferably the modular base structure has a depth dimension defined as extending from an in use upper horizontal plane to the lower horizontal plane of two upper and lower corner castings and allows for the upward protrusion of the casting of a shipping container to cause the modular beam structure to make up the difference in height between a short and tall shipping containers.

In a fourth aspect, the invention consists of a structure incorporating at least one modular beam structure substantially as specified herein.

Preferably the structure comprises one or more shipping container sized support members which are configured to support one or more of the structural beams.

Preferably the structure includes two or more spaced apart container sized support members and the structural beams span between the spaced apart container sized support members.

In a fifth aspect, the invention may broadly be said to consist a method of building a structure which includes the following components of structural support which includes shipping containers or wall supports, modular beam structures, modular base structures, wherein each modular beam structure spans a distance between and connects to structural support which includes a shipping container having end walls defining a length, side walls defining a width and a roof and floor defining a height and wall support, the modular beam structure including a lattice space truss frame structure made up of elongate members forming an elongate box like framed rectangular structure with several box-like cells with corners, the rectangular structure comprising longitudinal beam members, transverse cross beam members and diagonal beam members connected together, corner castings located at each corner and non-corner castings located between each corner with each corner casting and non-corner casting including suitably sized and oriented slot apertures for receipt of part of a twist lock assembly as provided in the wall supports wherein the rectangular structure includes an angled top portion and level bottom portion wherein the longitudinal beam members define a length and the transverse beams define a width such that the length and width of the rectangular structure is a multiple of the length of the shipping container or wall support to enable end support of the corner castings and non-corner castings on a shipping container or wall support and be able to be assembled on top of each other or be overlapping creating a shipping container volume size allowing transport within shipping containers, each modular base structure provides a base connected to a top of structural support which includes a shipping container and/or wall support, for connection of at least one end portion of a modular beam structure without loading the walls of the shipping container or wall support, the modular base structure having a length, width and height, the modular base structure including an elongate lattice space frame structure forming a single planar like rectangular structure having the following faces of: end faces, top face, bottom face, front side edge face and rear side edge face, the rectangular structure comprising longitudinal beam members and transverse cross beam members connected together, the planar like structure formed from elongate members with corners and intersections between the elongate members, and having upper and lower corner castings located at each corner whereby the upper corner casting includes a twist lock assembly therein for adjustable connection to another corner casting of a modular beam structure and the lower corner casting having a slot aperture for locking receipt of a twist lock assembly of the shipping container or wall support, the space frame structure including interconnecting longitudinal beam members and transverse beam members forming cells there between whereby the transverse beam members intersect with the longitudinal beam members and include non-corner upper castings having twist lock assembly in an upper portion for locking receipt in slotted apertures of other corner castings of another modular beam structure and the distance between the corner and intersection or between the intersection to another intersection being dimensioned to receive a width of the other modular beam structure, wherein the longitudinal beam members define a length and the transverse beams define a width such that the length and width of the rectangular structure is at least a multiple or complete length of the length of the shipping container or wall support, wherein the modular beam member spans between the shipping container and a wall support by being connectively supported at each end and at, at least one end by one modular base structure connected to the top the shipping container which functions as a wall support for the modular base structure and at an end of the modular beam structure whereby the components of the present invention are standardized in shape and structure to allow assembly and disassembly in relation to any sized shipping container and also transportation, using the shipping containers to carry most or at least part of the components of the building structure assembly, the method of building a structure including the steps of;

Arrange suitable shipping containers or wall support to form the wall supports of a proposed building structure being spaced apart forming a roof spanning distance there between;

Place modular base structures onto the top of the shipping containers;

Operate twist locks of the shipping container to lock the modular base structure to the shipping container;

Positon end portion of a modular beam structure onto the top of a modular base structure;

Operate twist locks in lower portion of the modular beam structure to lock the beam structure to the modular base structure;

Repeat process for locking in as many modular beam structures to completely cover the modular base structure 2 and shipping container to form one side of the span between the shipping containers;

Repeat process for other side of span;

Bolt the ends of each opposing modular beam structure at a central span position to form a roof support;

Cover the roof support with suitable covering.

The invention may also broadly be said to consist in the parts, elements and features referred to or indicated in the specification of the application, individually or collectively, and any or all combinations of any two or more of the parts, elements or features, and where specific integers are mentioned herein which have known equivalents, such equivalents are incorporated herein as if they were individually set forth.

DESCRIPTION OF THE PREFERRED EMBODIMENTS

Figure 5:
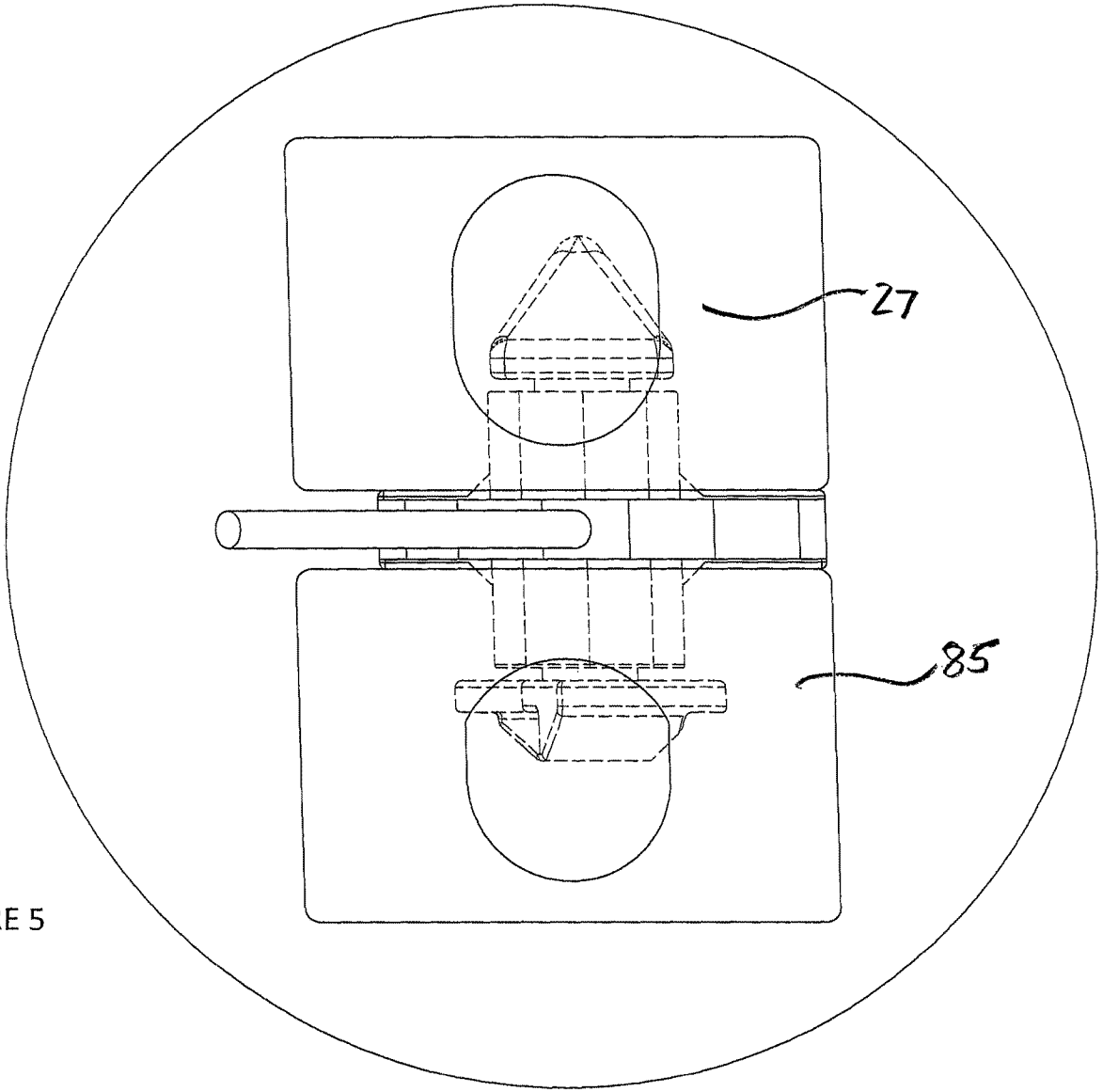
Figure 6:
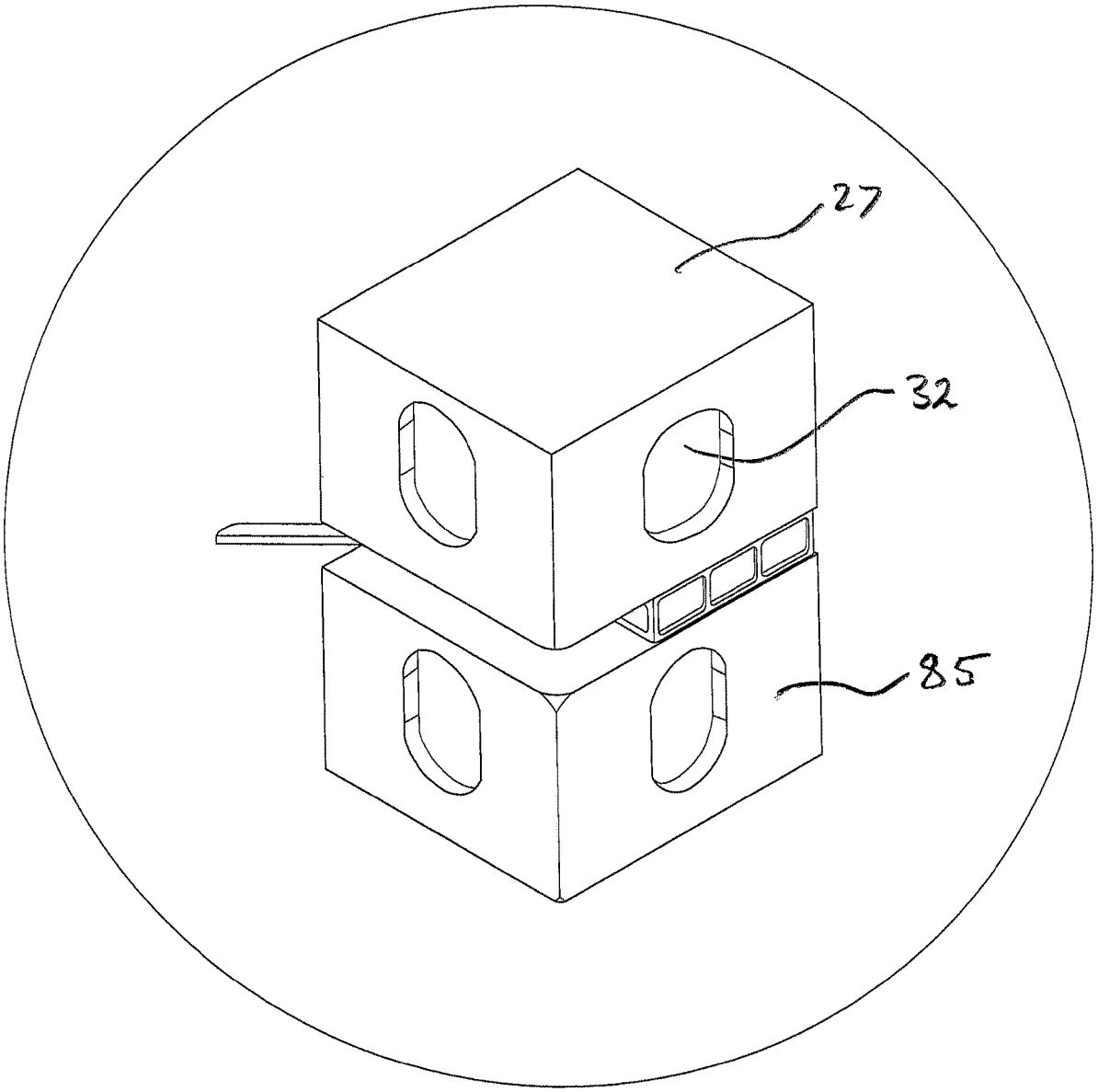

Further aspects of the present invention will become apparent from the following description which is given by way of example only and with reference to the accompanying drawings in which:

FIG. 1 is a perspective view of a modular beam structure and modular base structure in use with a 20 ft (6096 mm) shipping container, FIG. 2 is a close up perspective view of a corner part of the modular base structure connecting to the shipping container, FIG. 3 is a perspective view showing the modular base structure connecting to the modular beam structure, FIG. 4 is a perspective view of the modular beam structure connecting to the modular base structure, FIG. 5 is a side view of an upper casting with twist lock of a 20 ft (6096 mm) shipping container and a lower corner casting of the modular base structure showing the twist lock assembly in between castings, FIG. 6 is a perspective view of similar components to FIG. 5.

Figure 7:
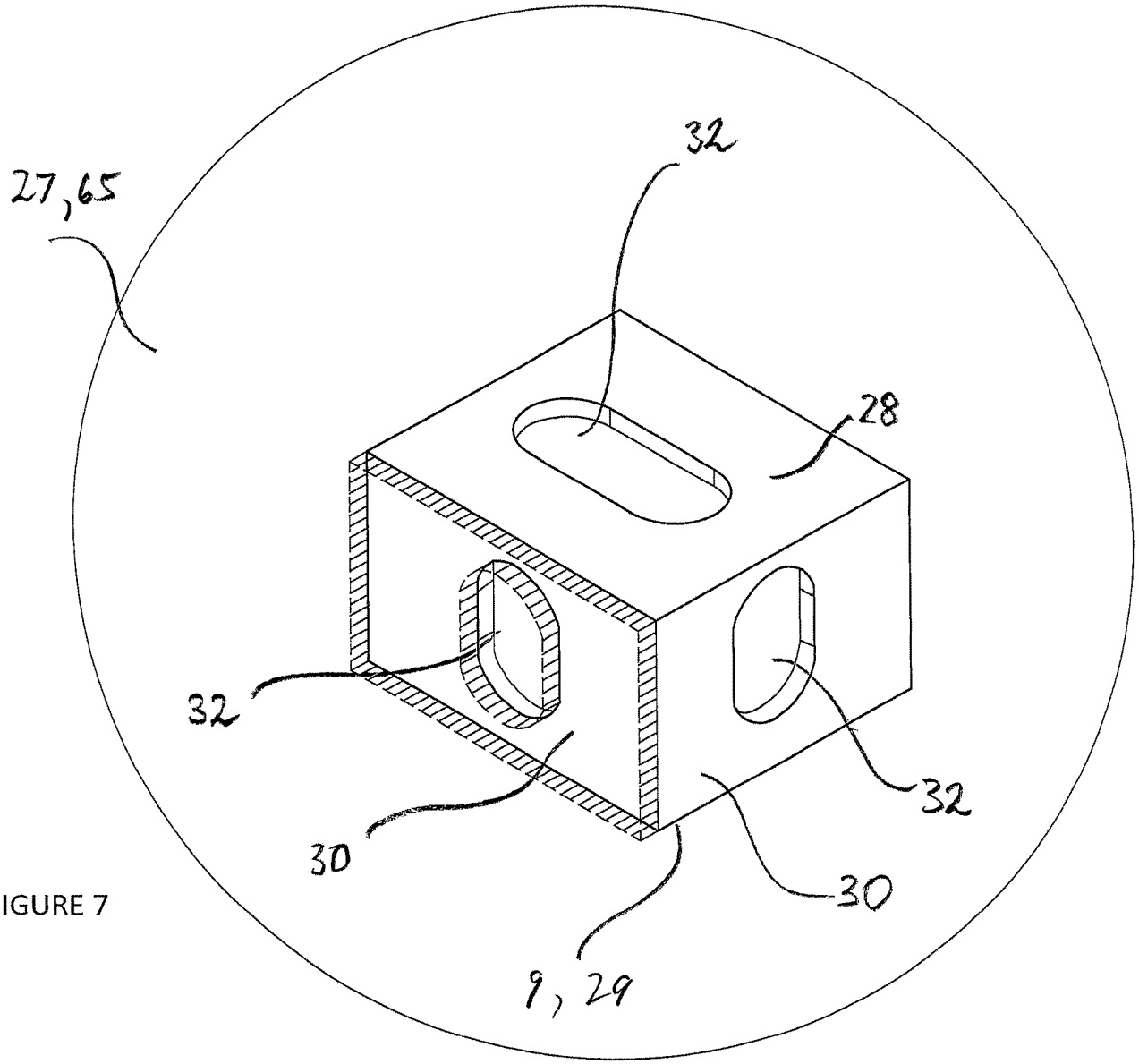
Figure 8:
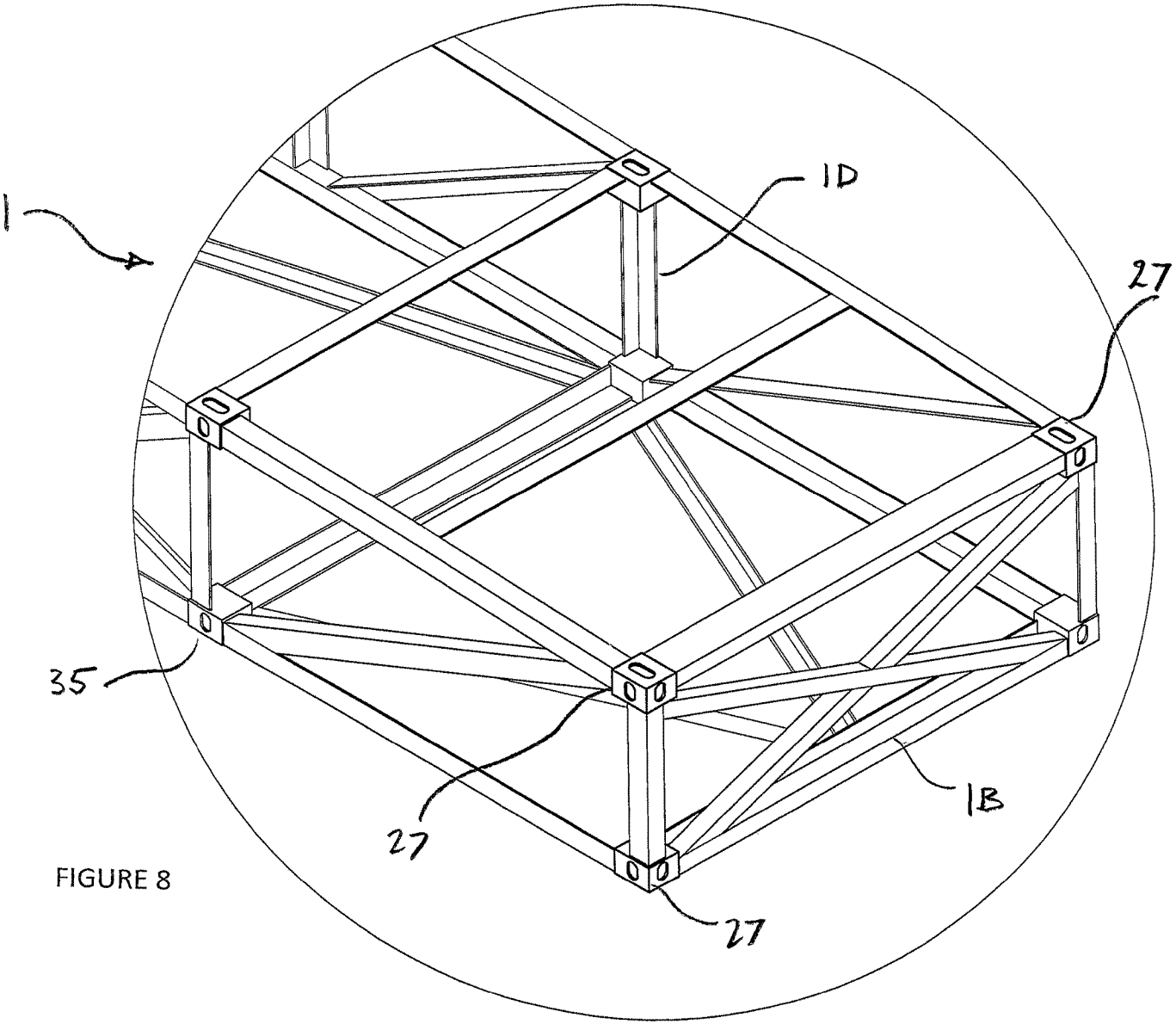
Figure 9:
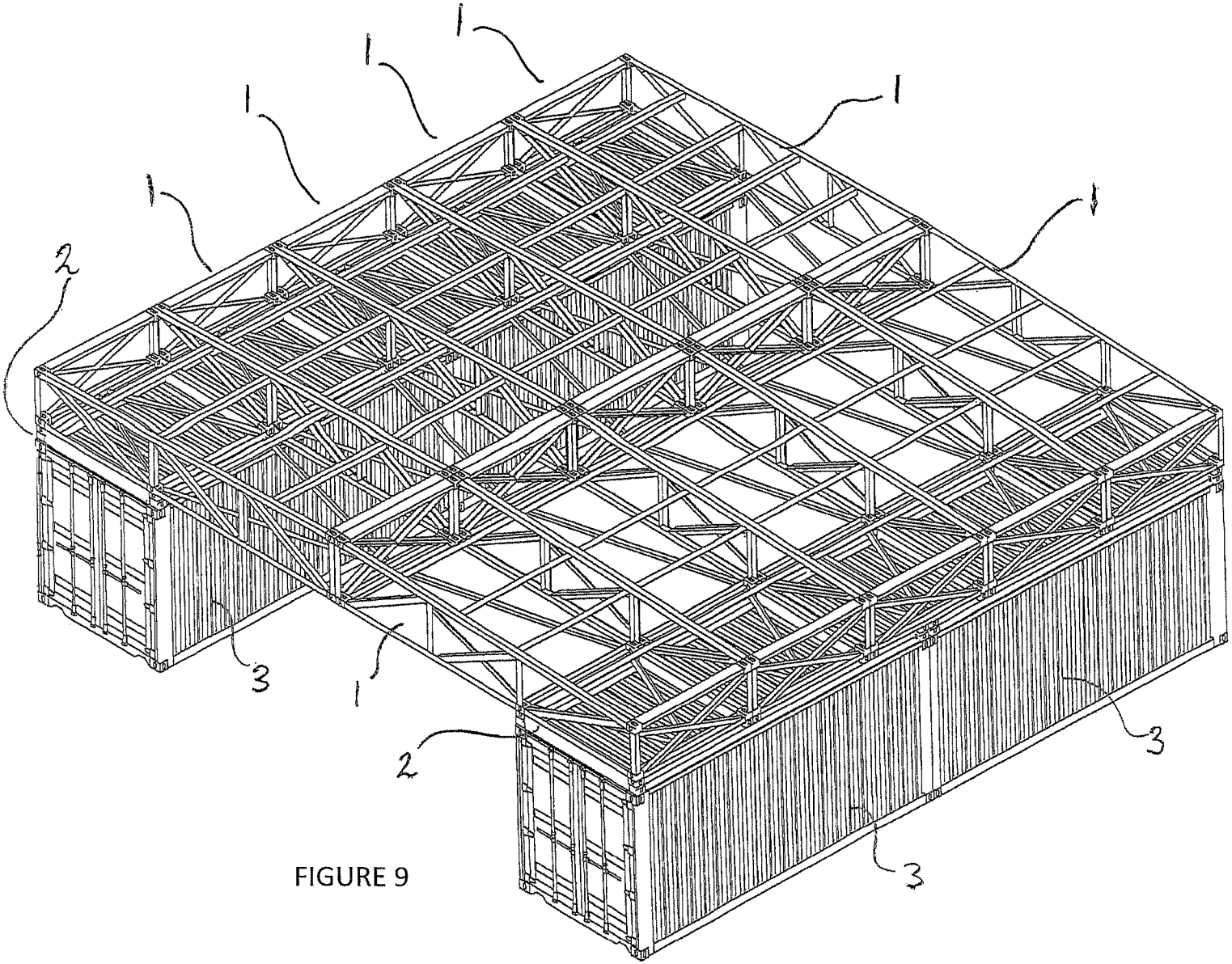
Figure 10:
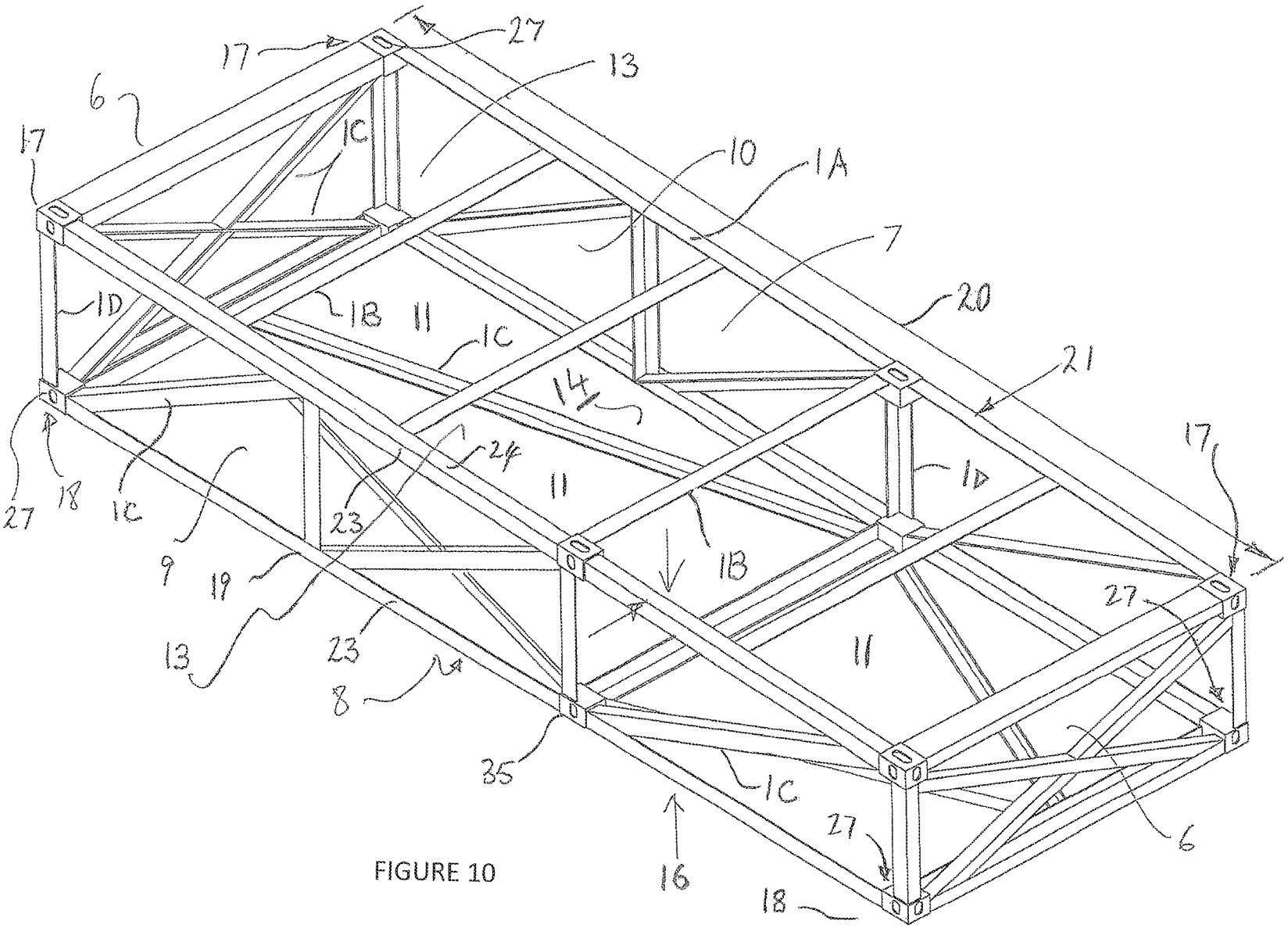
Figure 11:
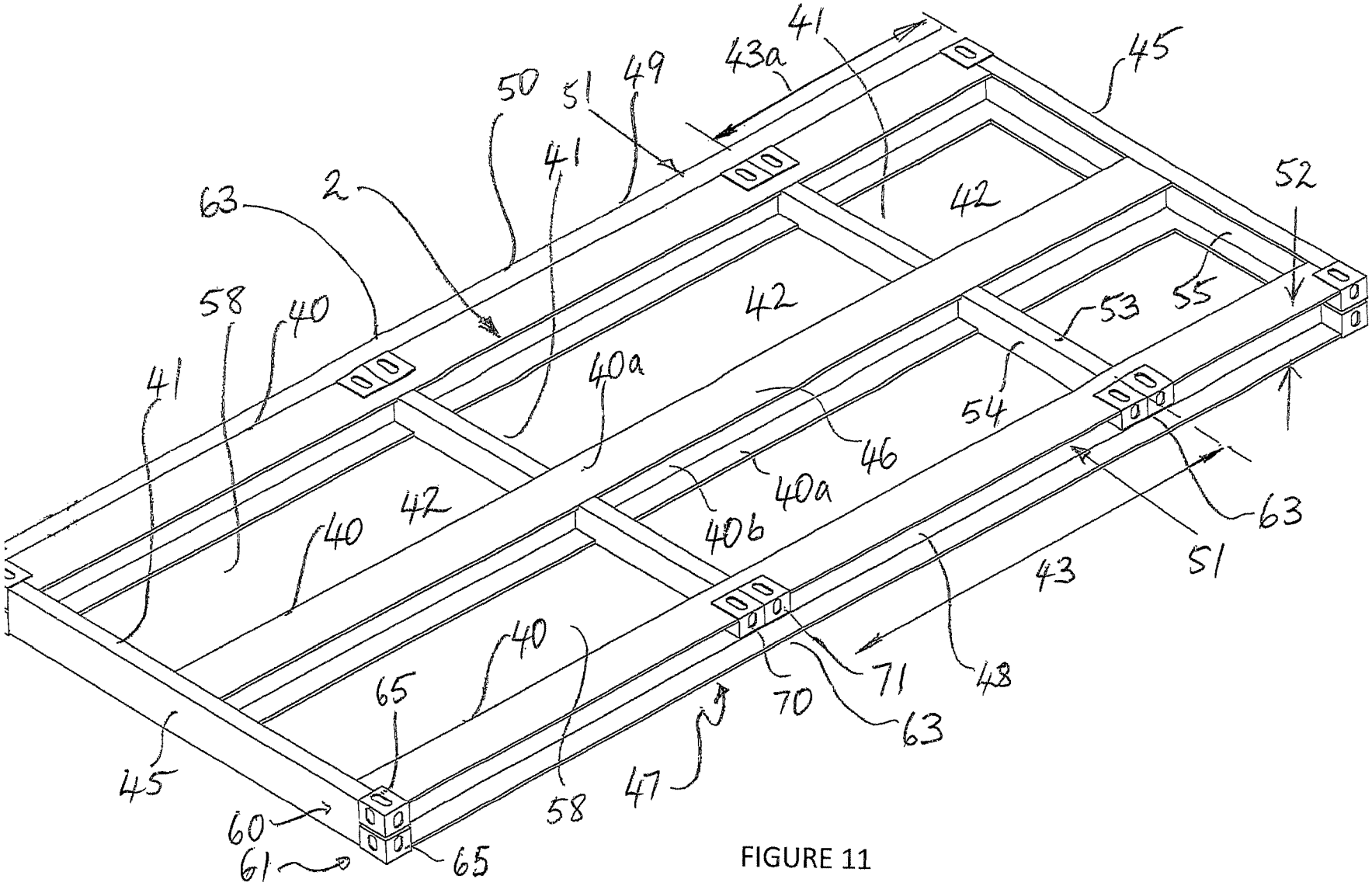
Figures 12, 13, 14, 15, 20:
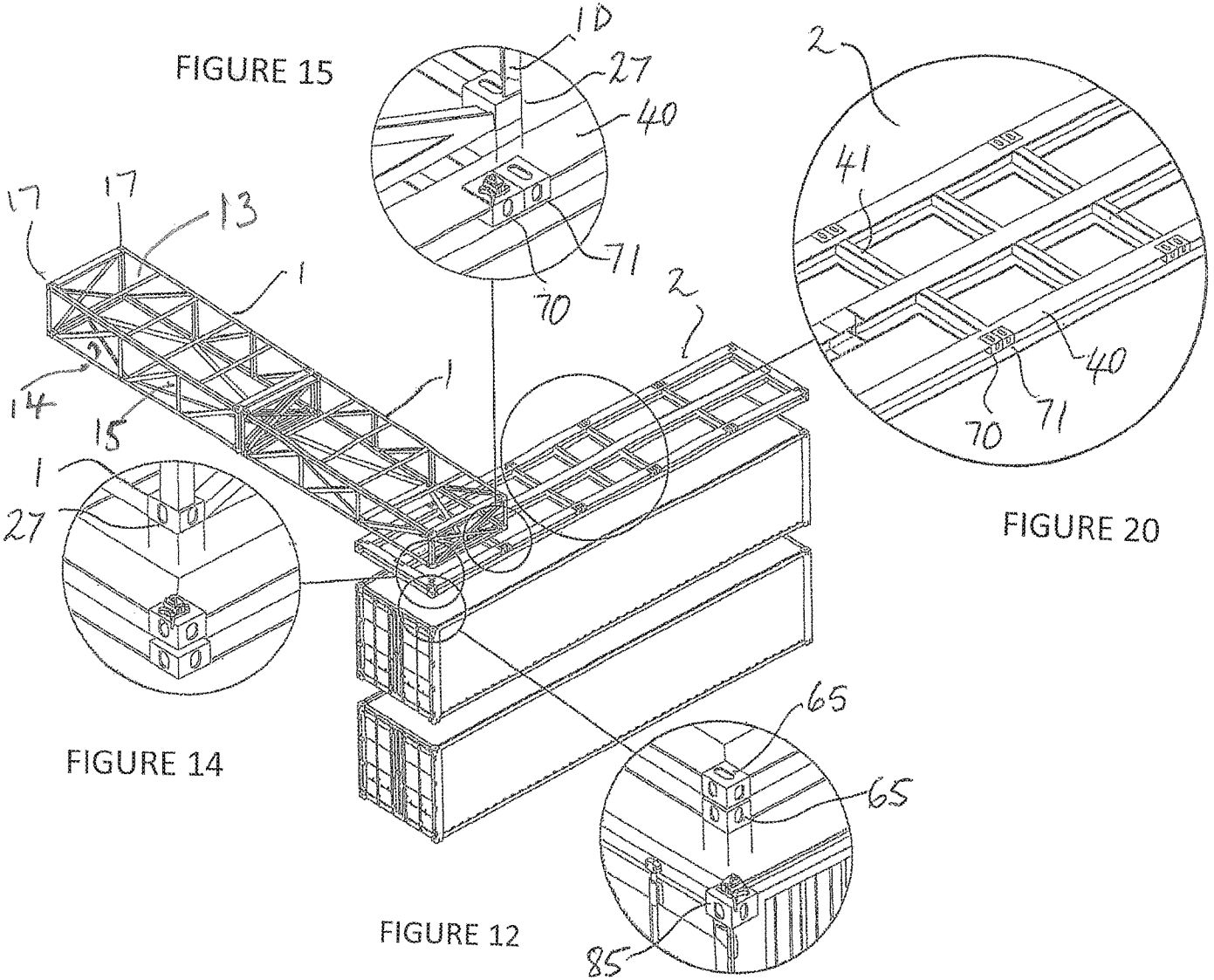
Figure 13:
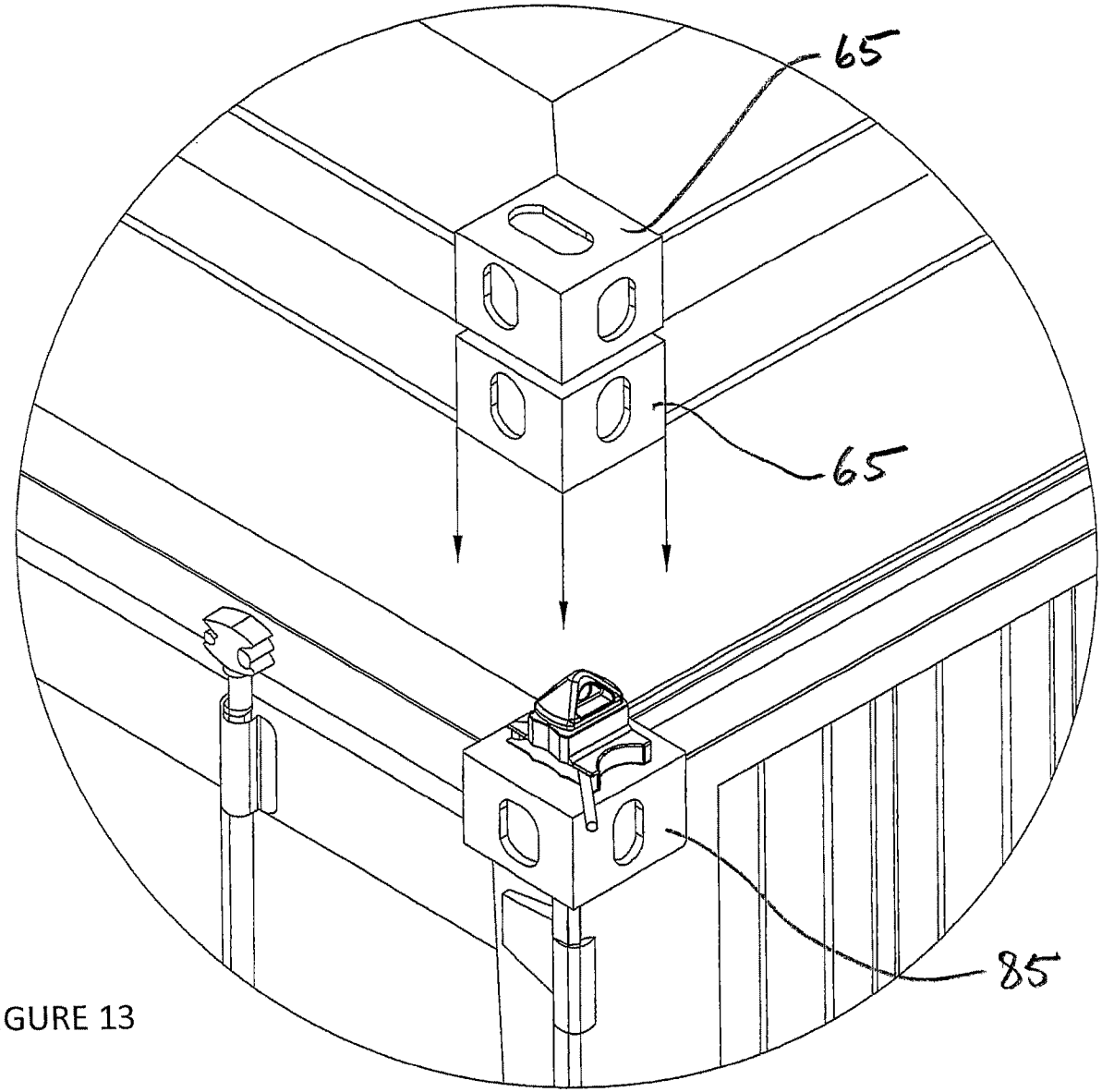
Figure 14:
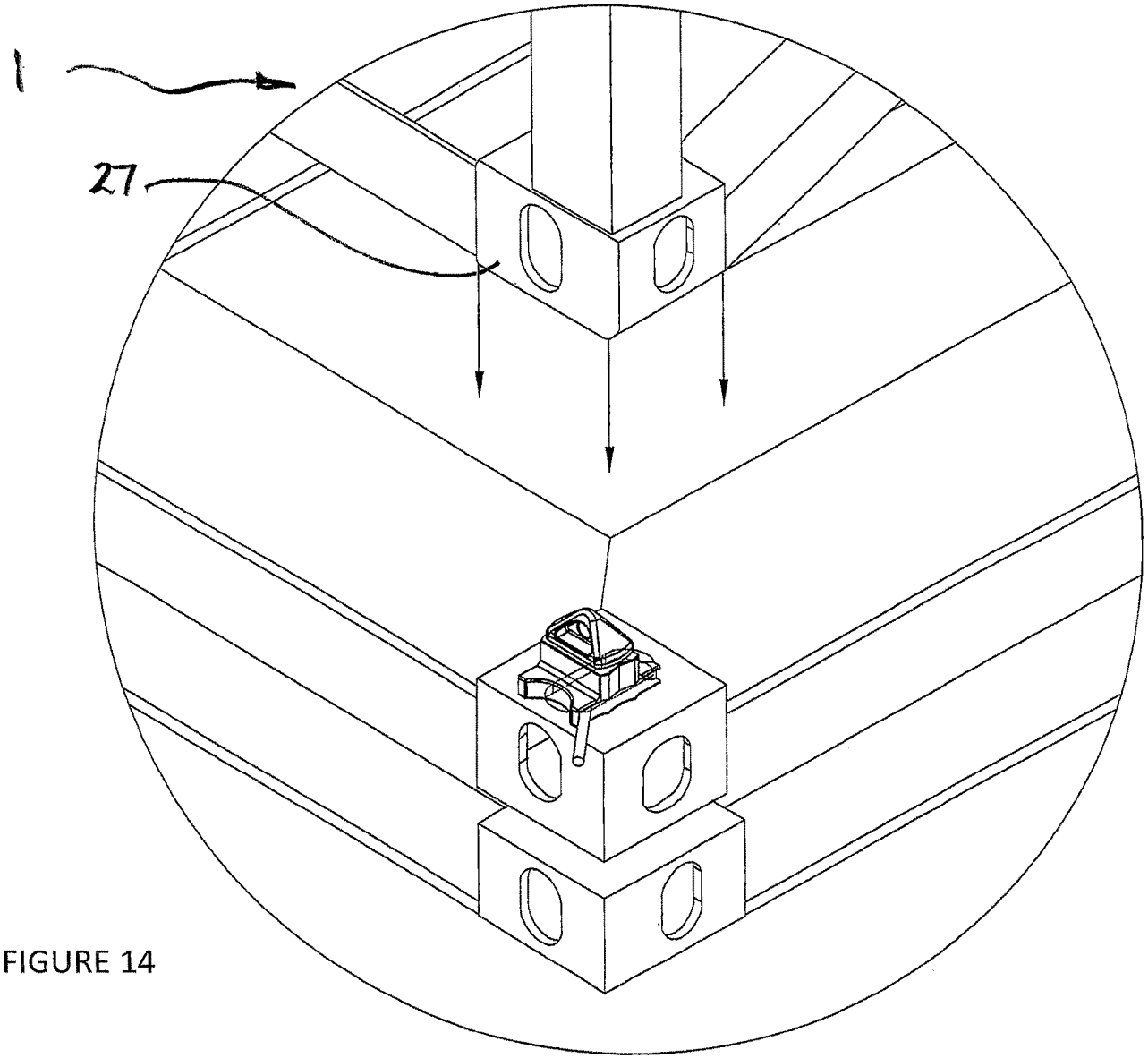
Figure 15:
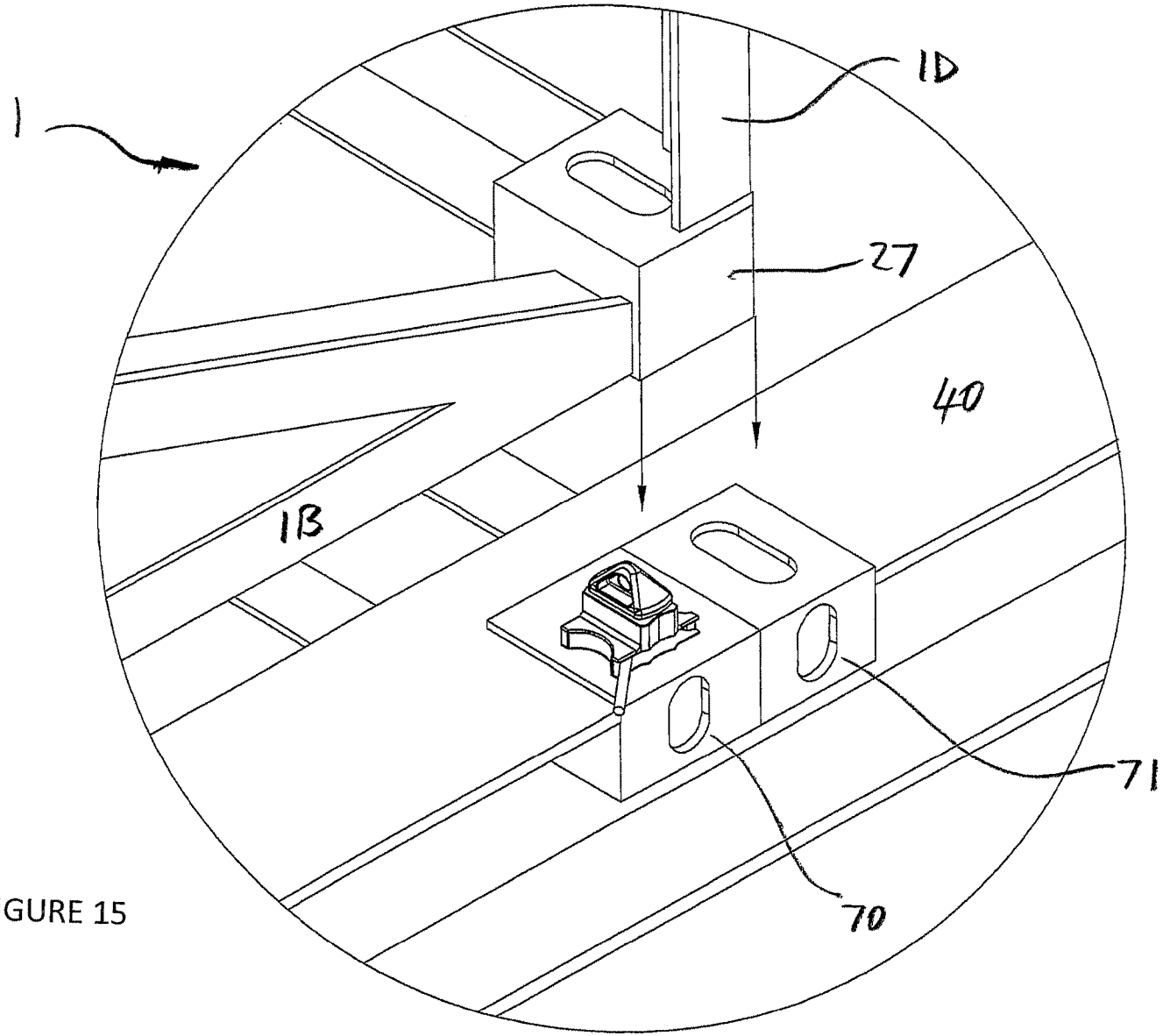
Figure 16:
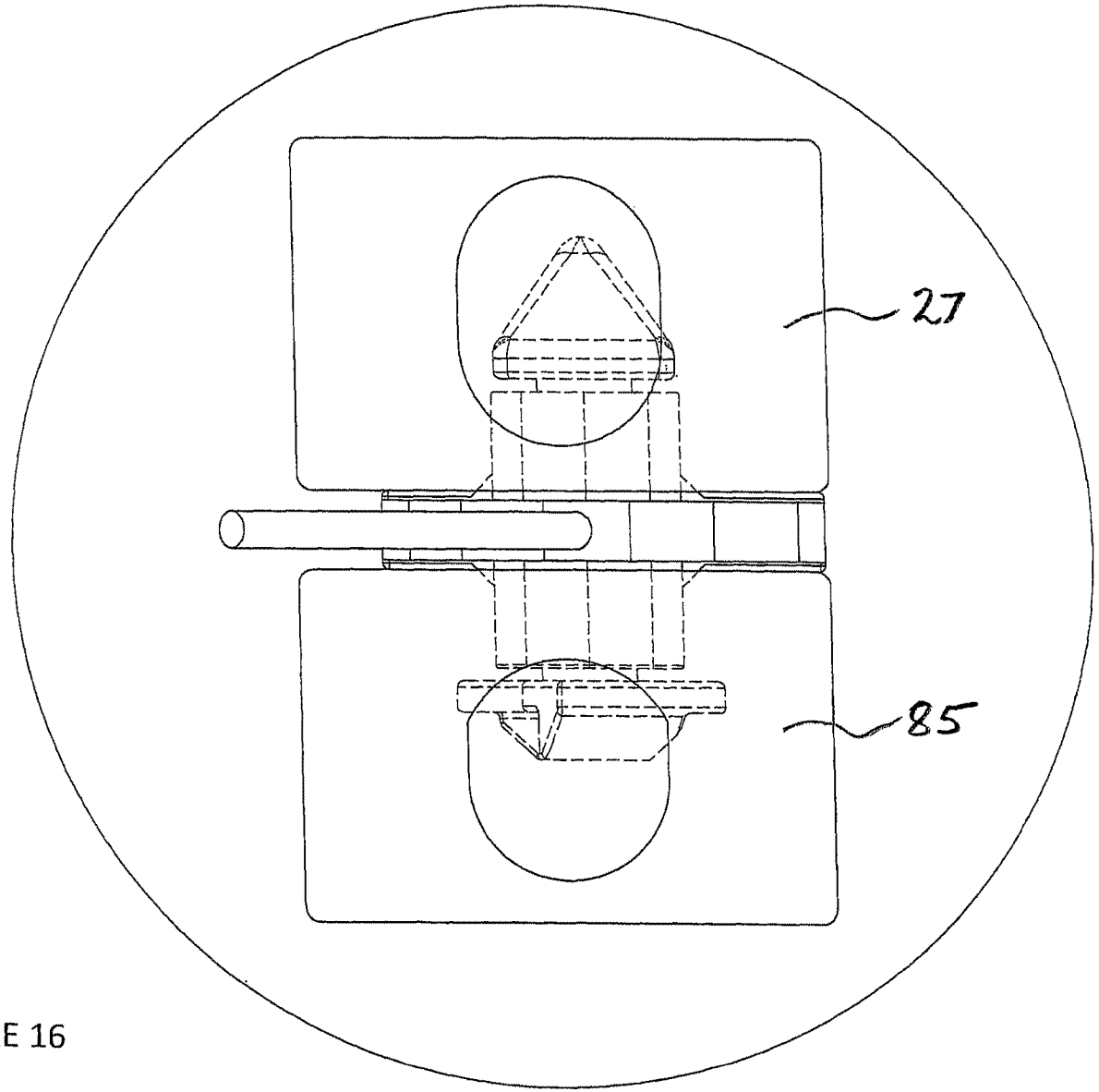
Figure 17:
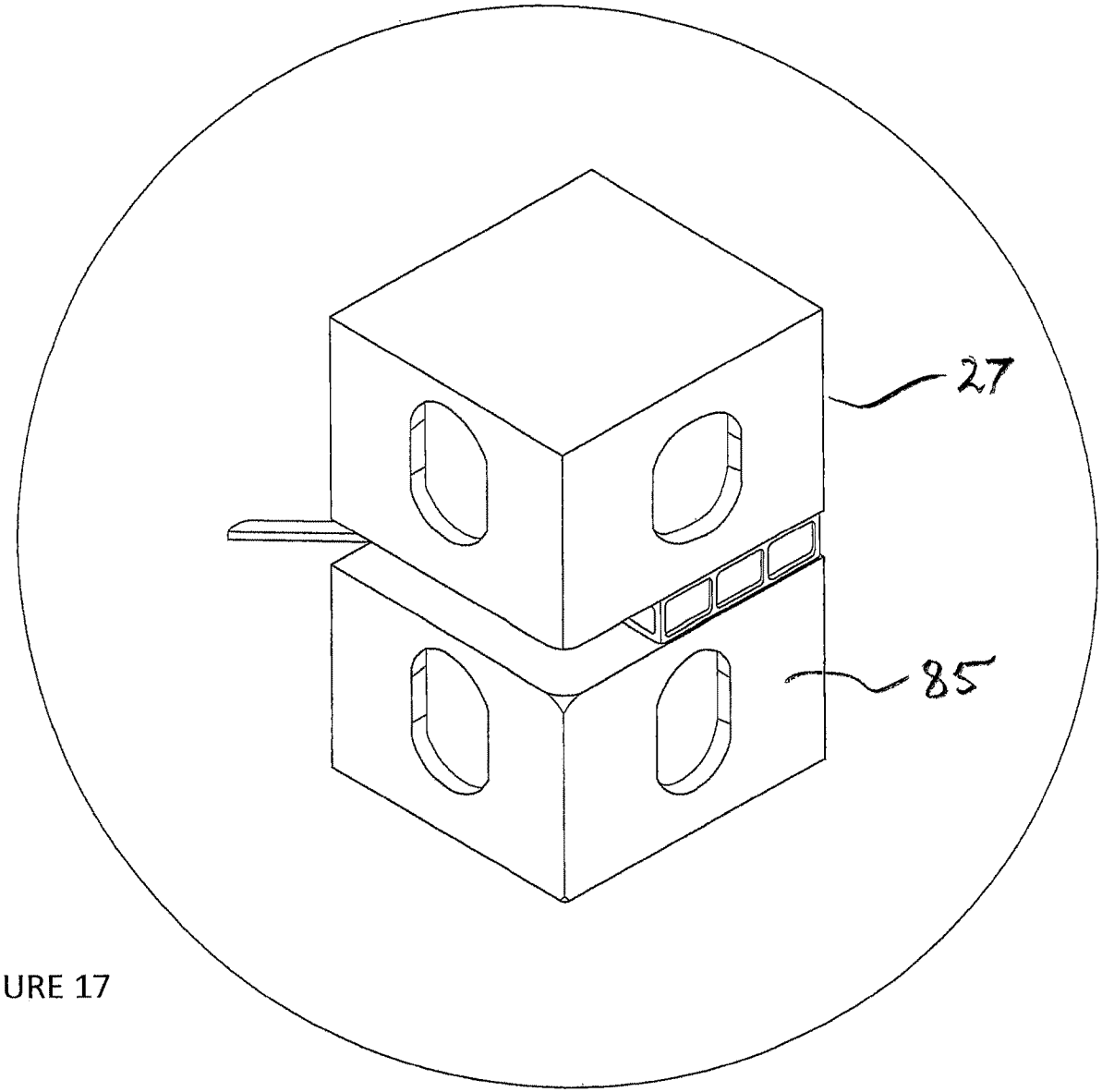
Figure 18:
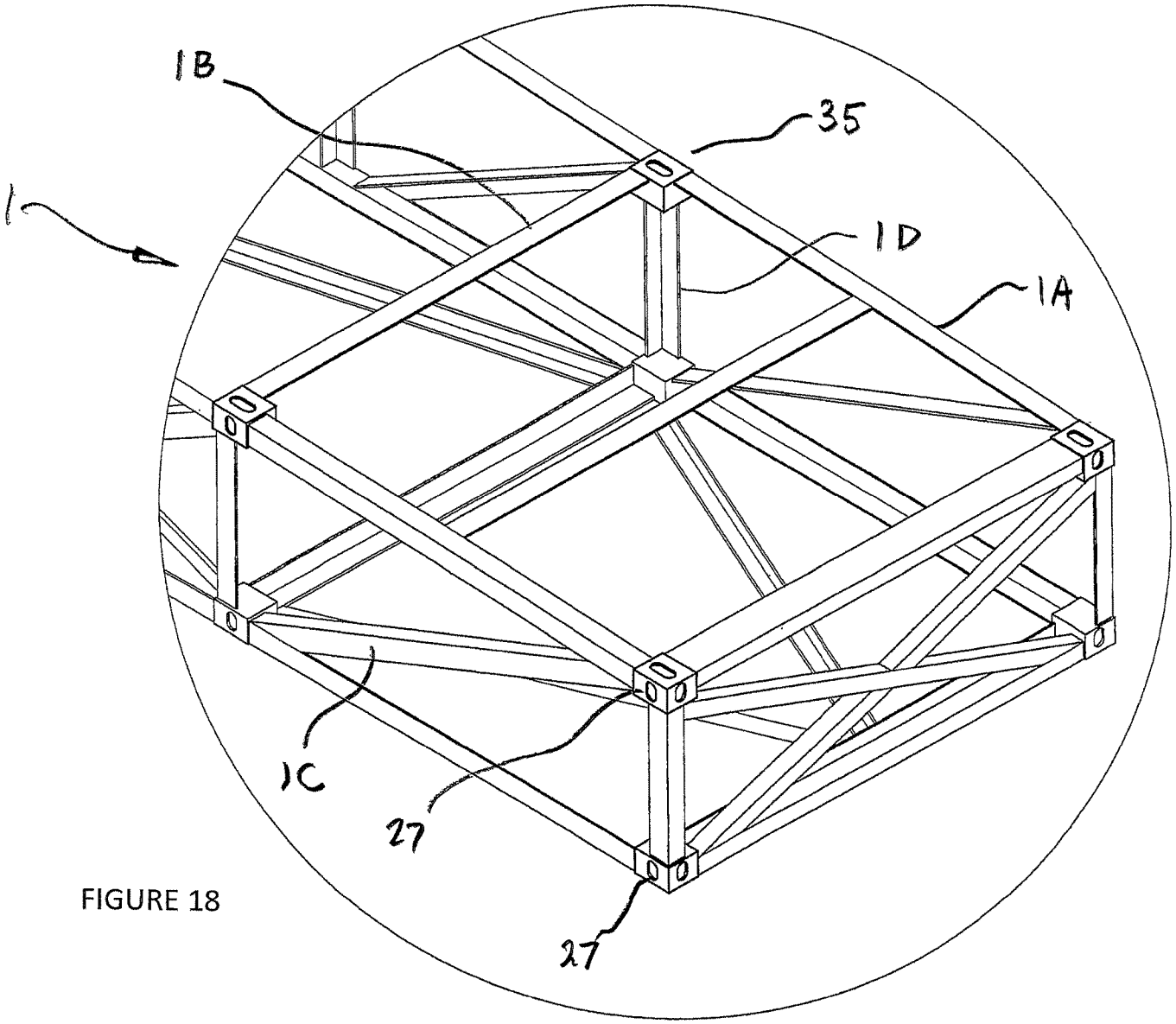
Figure 19:
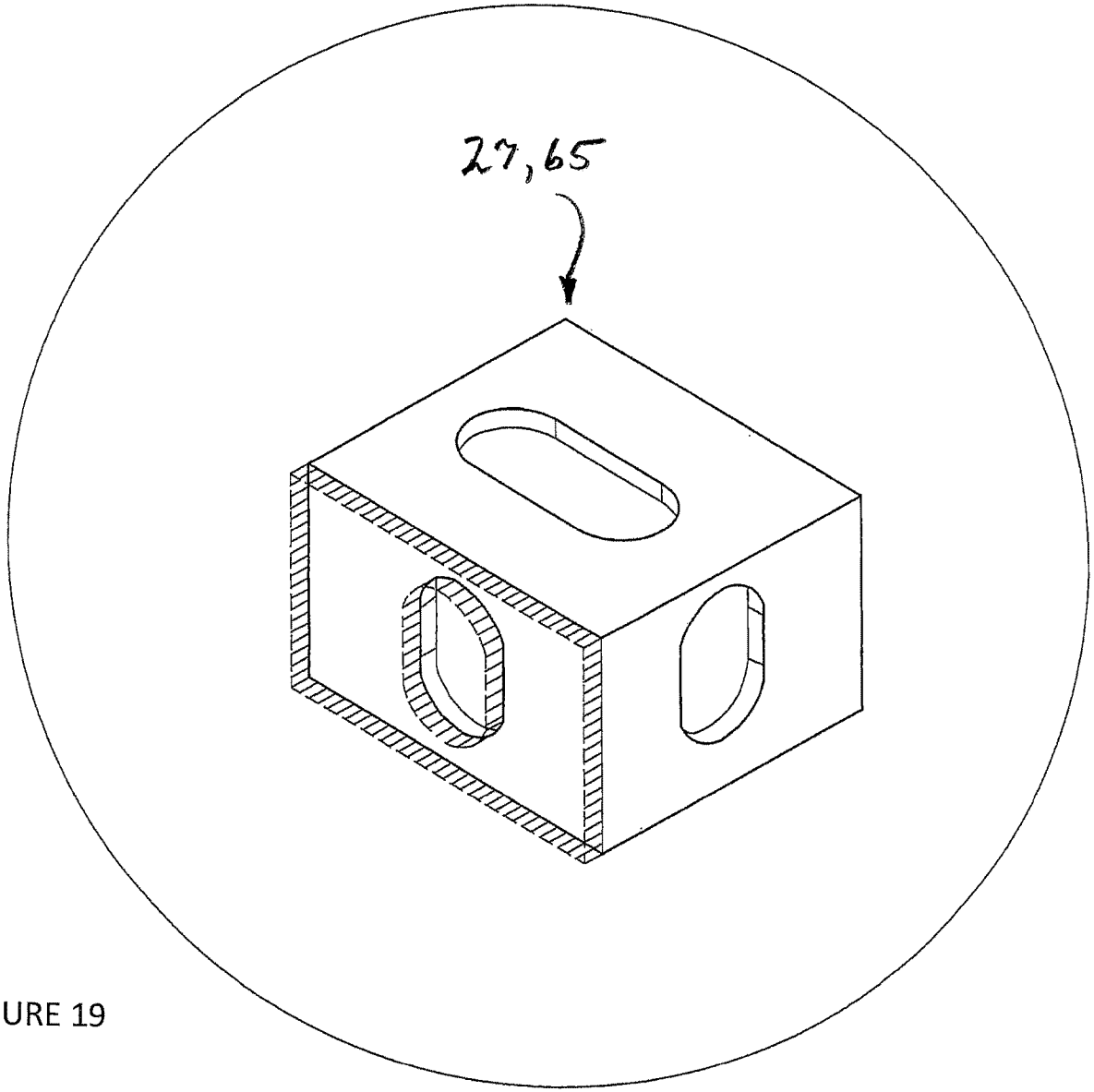
Figure 20:
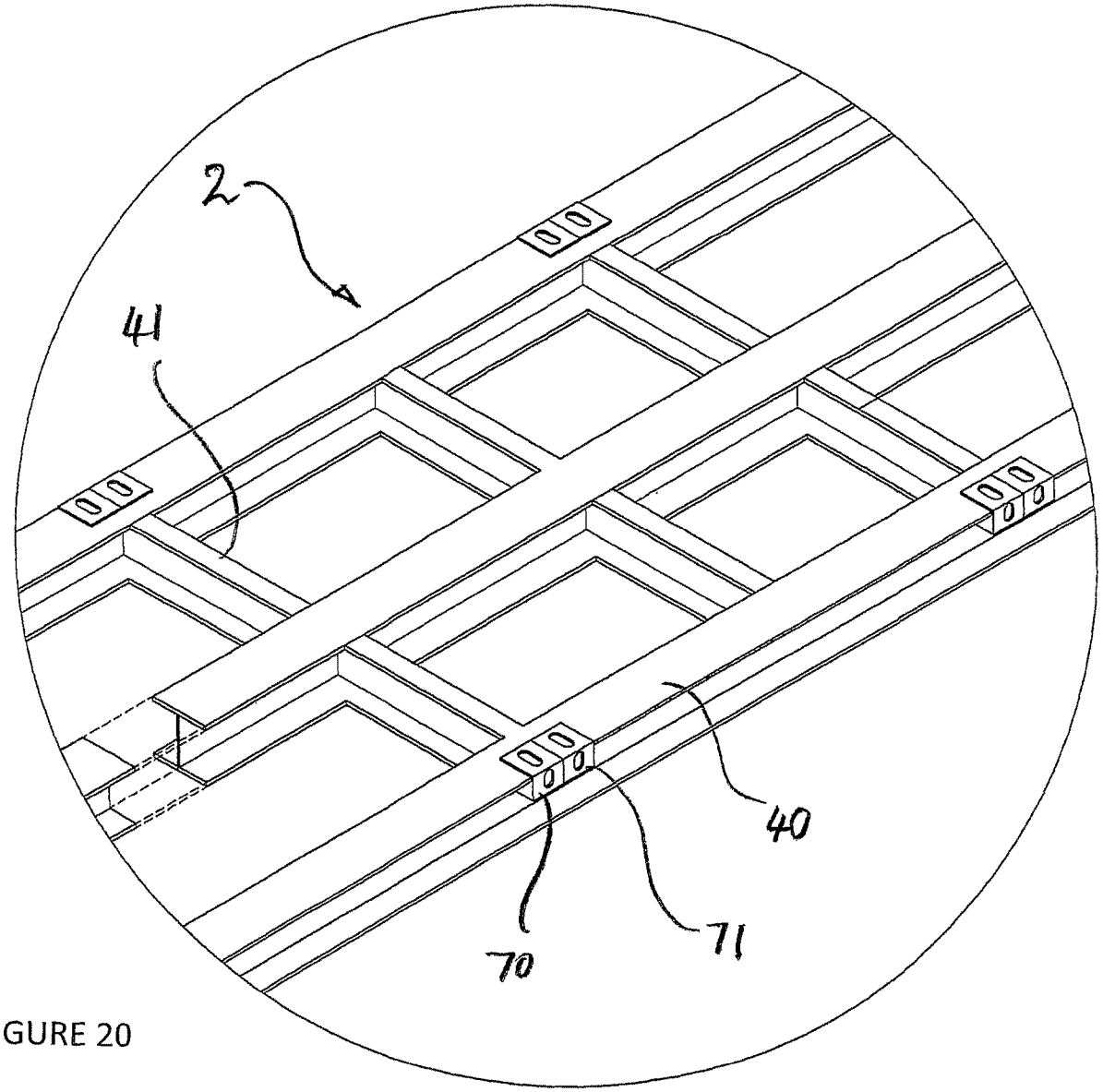
Figure 21:
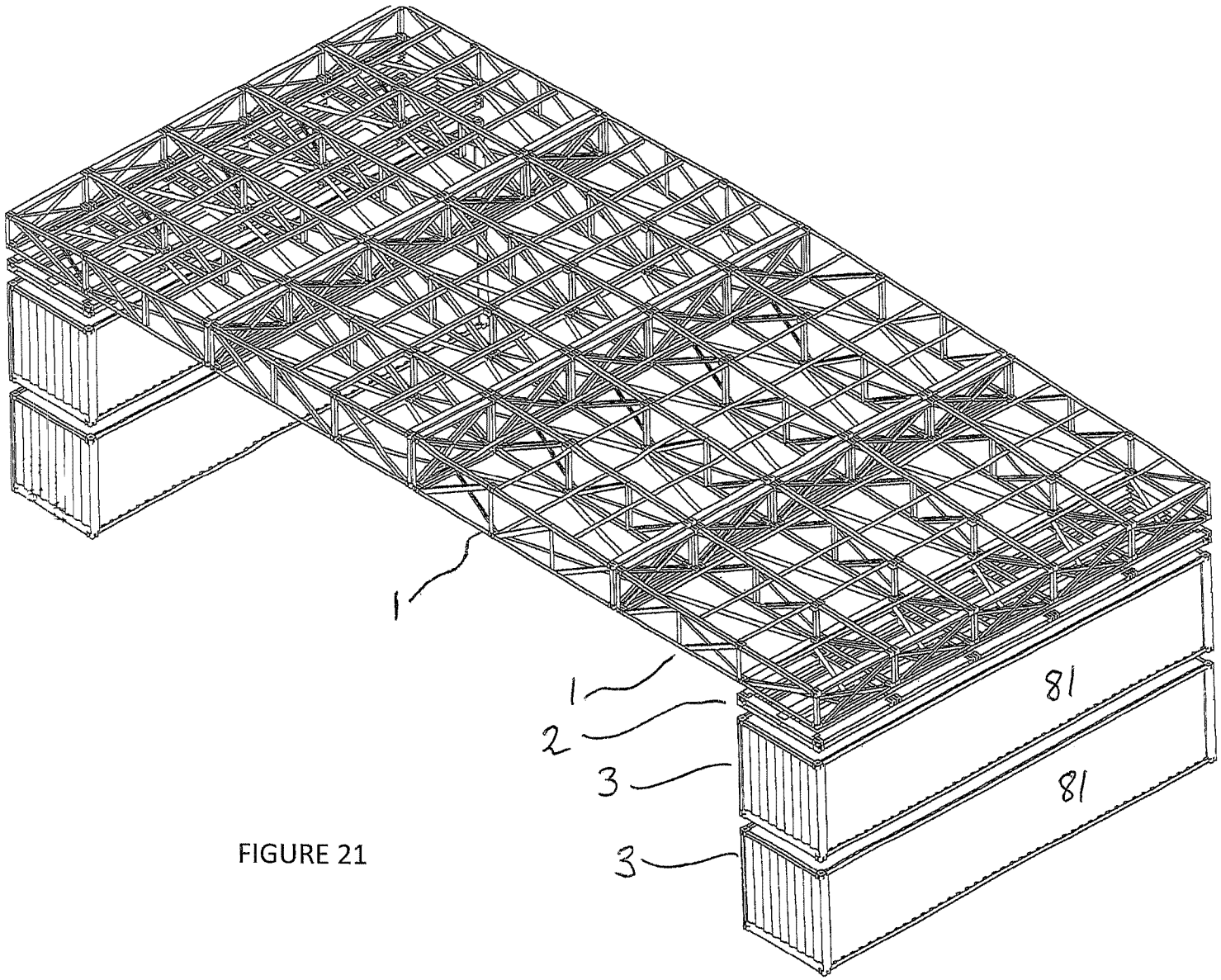
Figure 22:
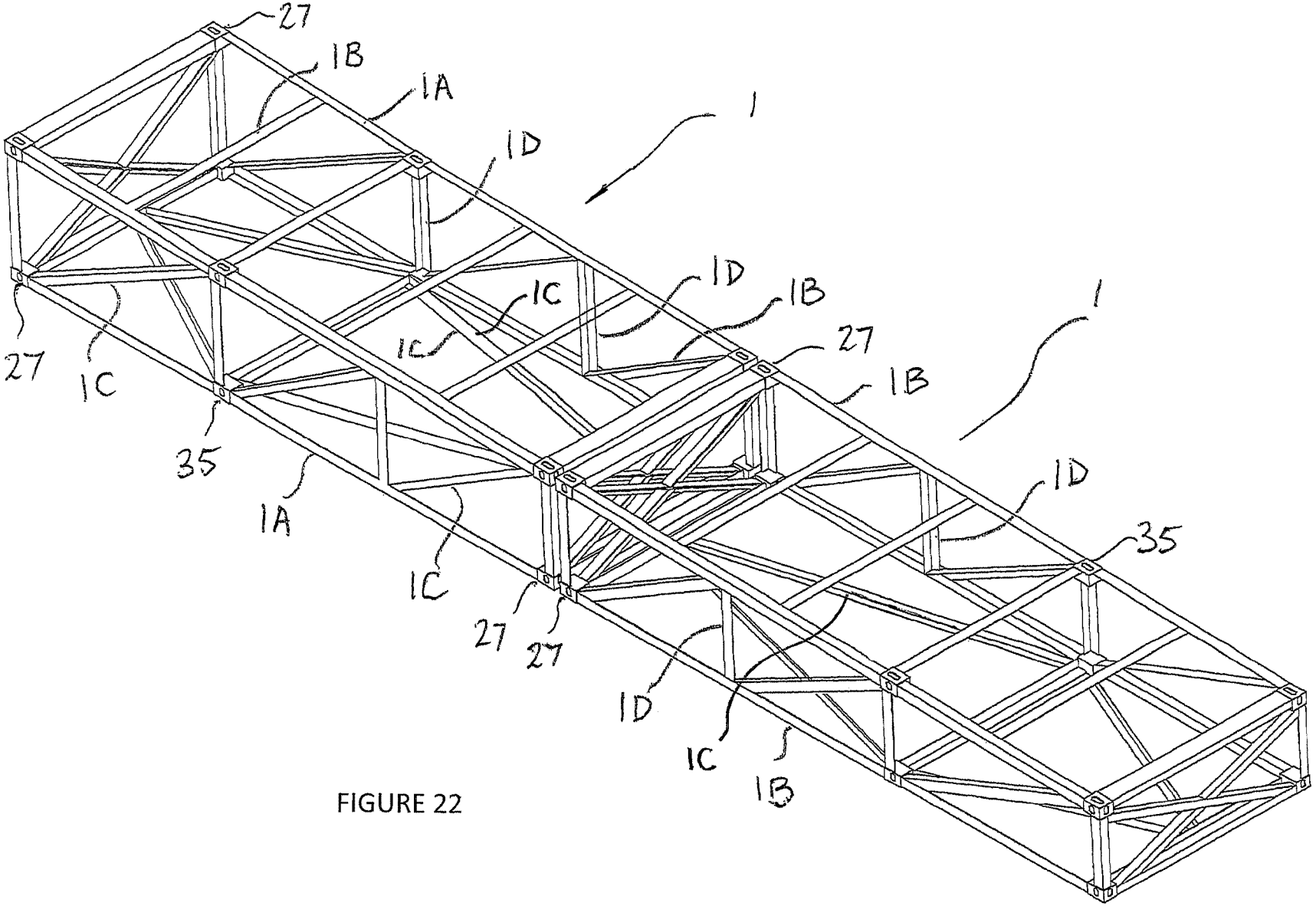
Figure 23:
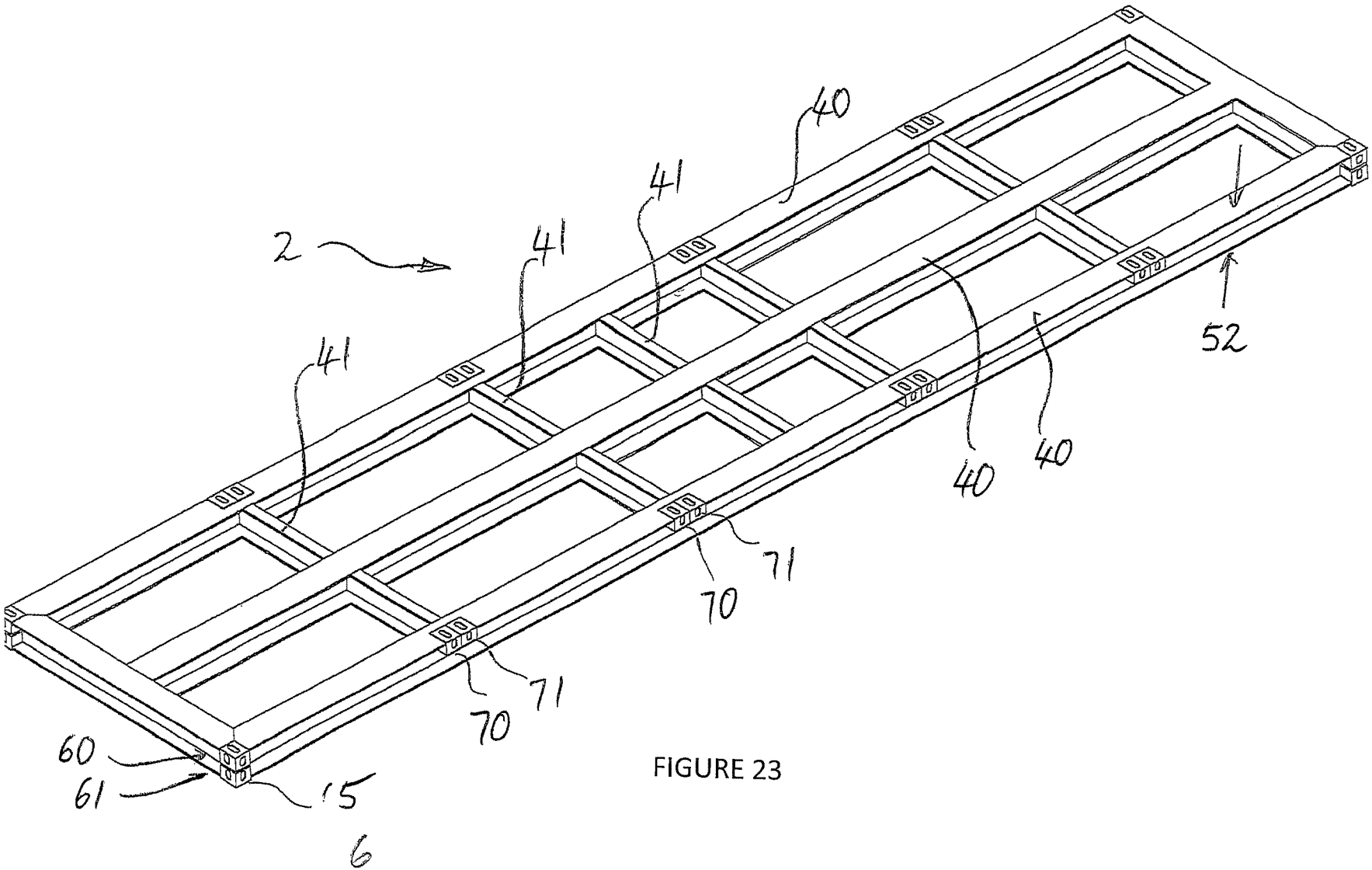
Figure 24:
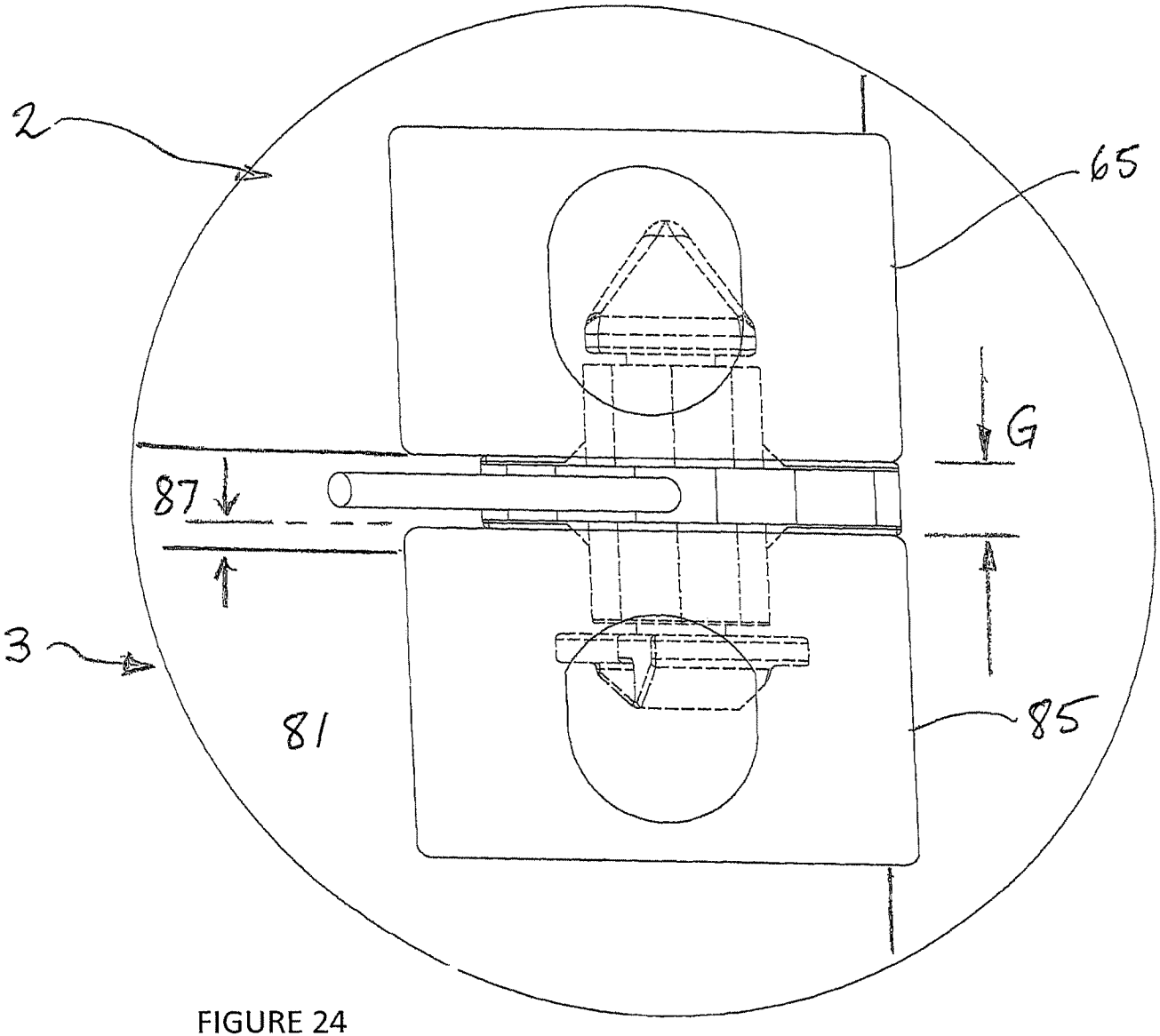
Figure 25:
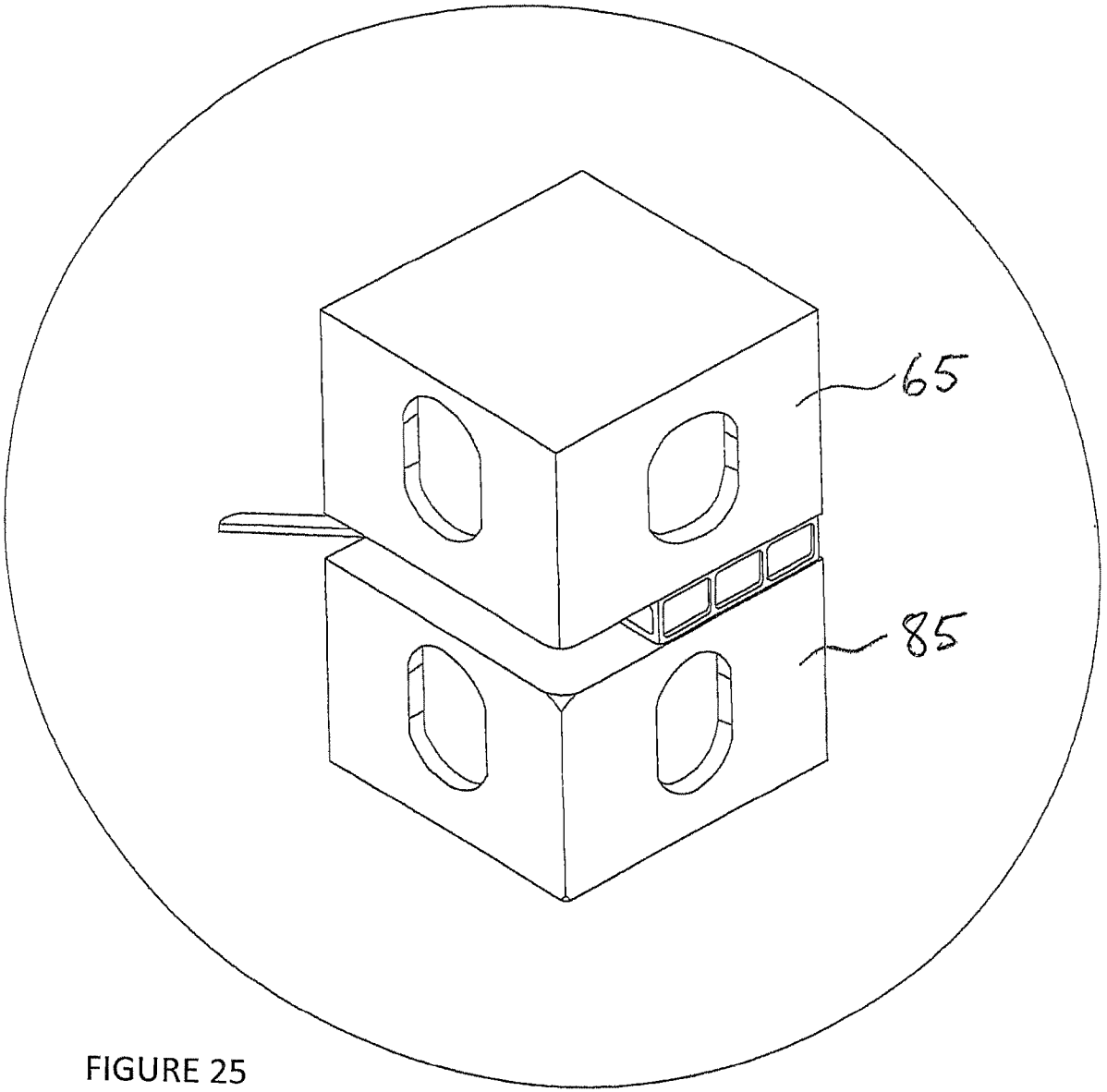
Figure 26:
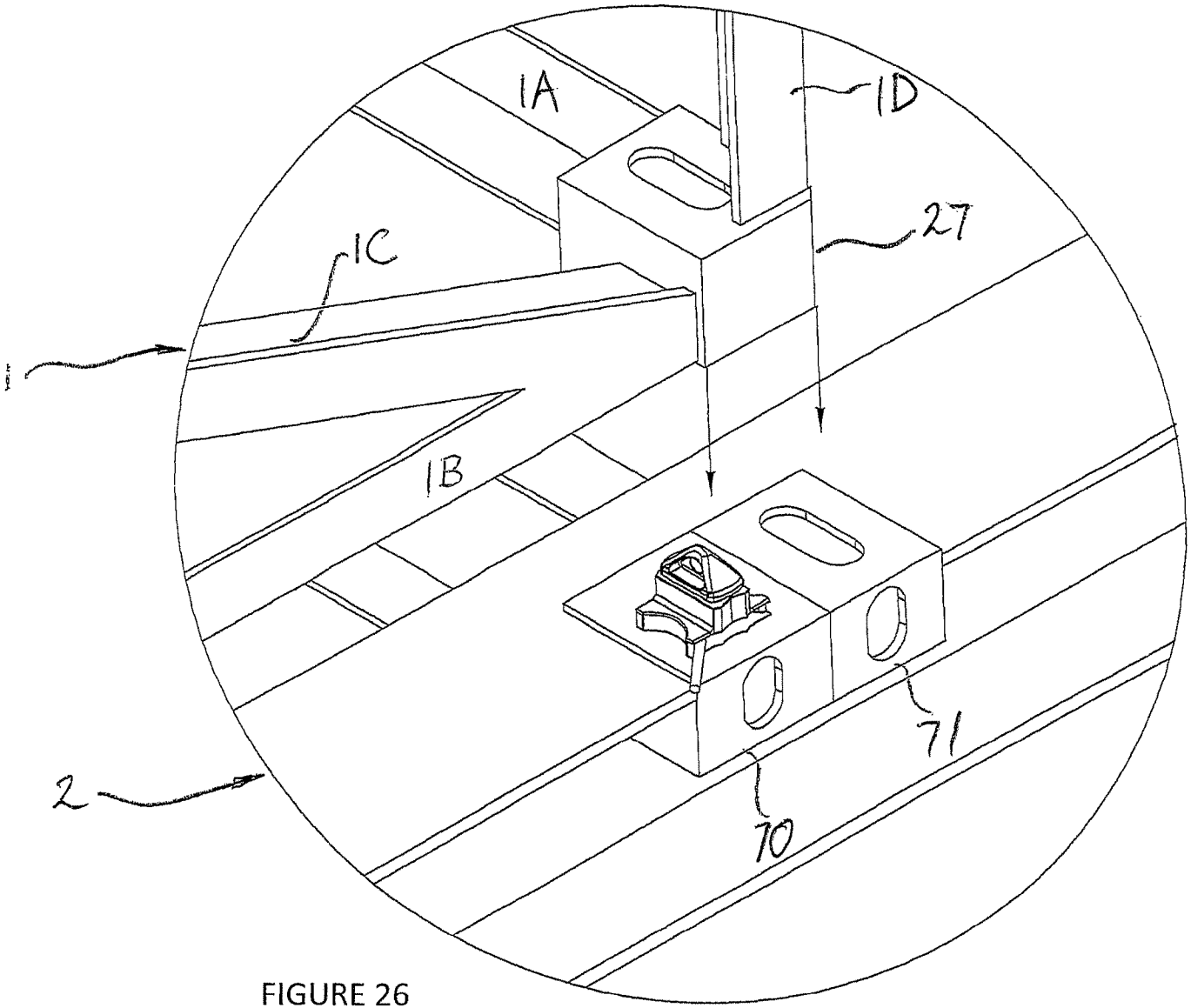
Figure 27:
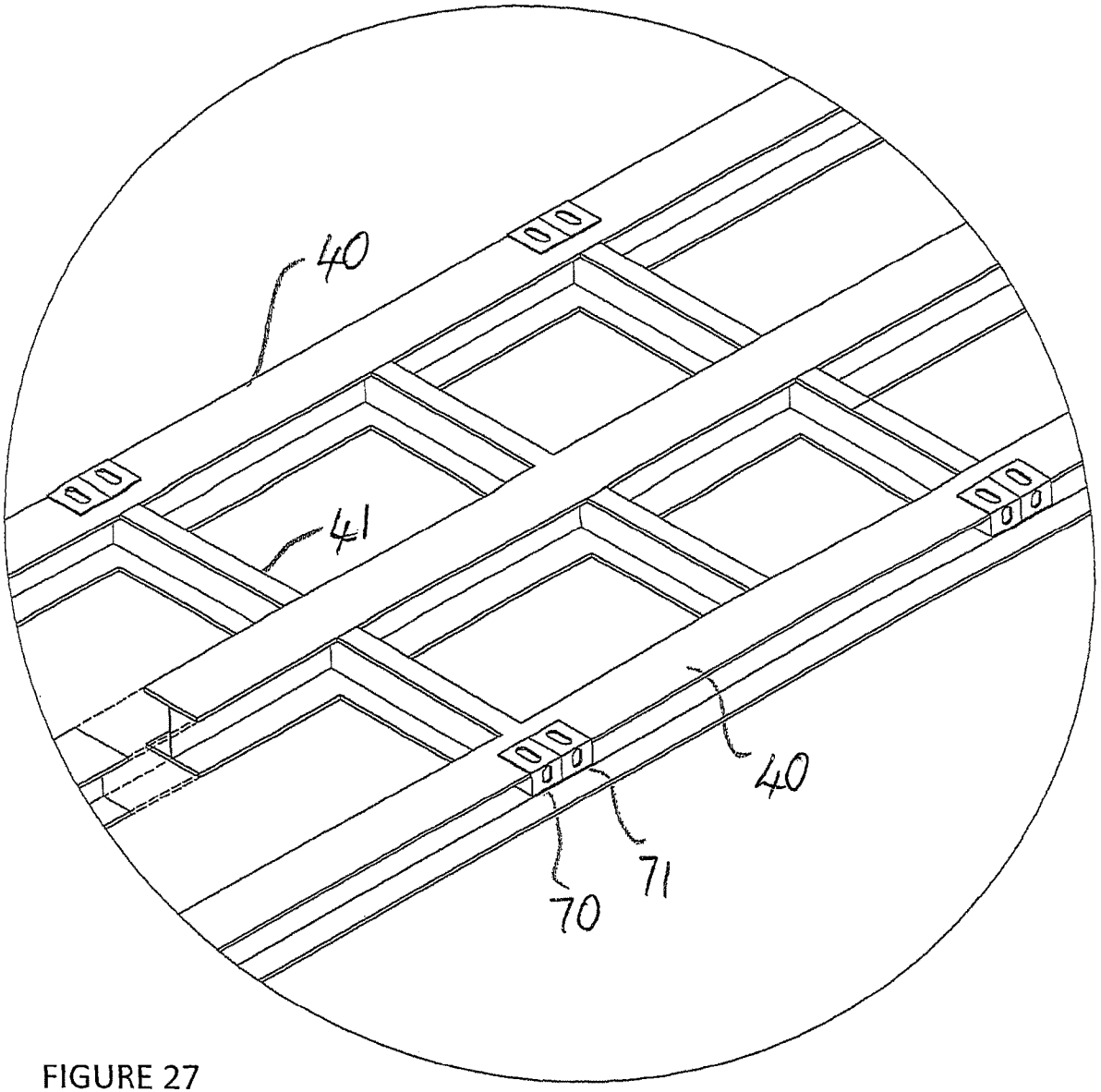
Figure 28:
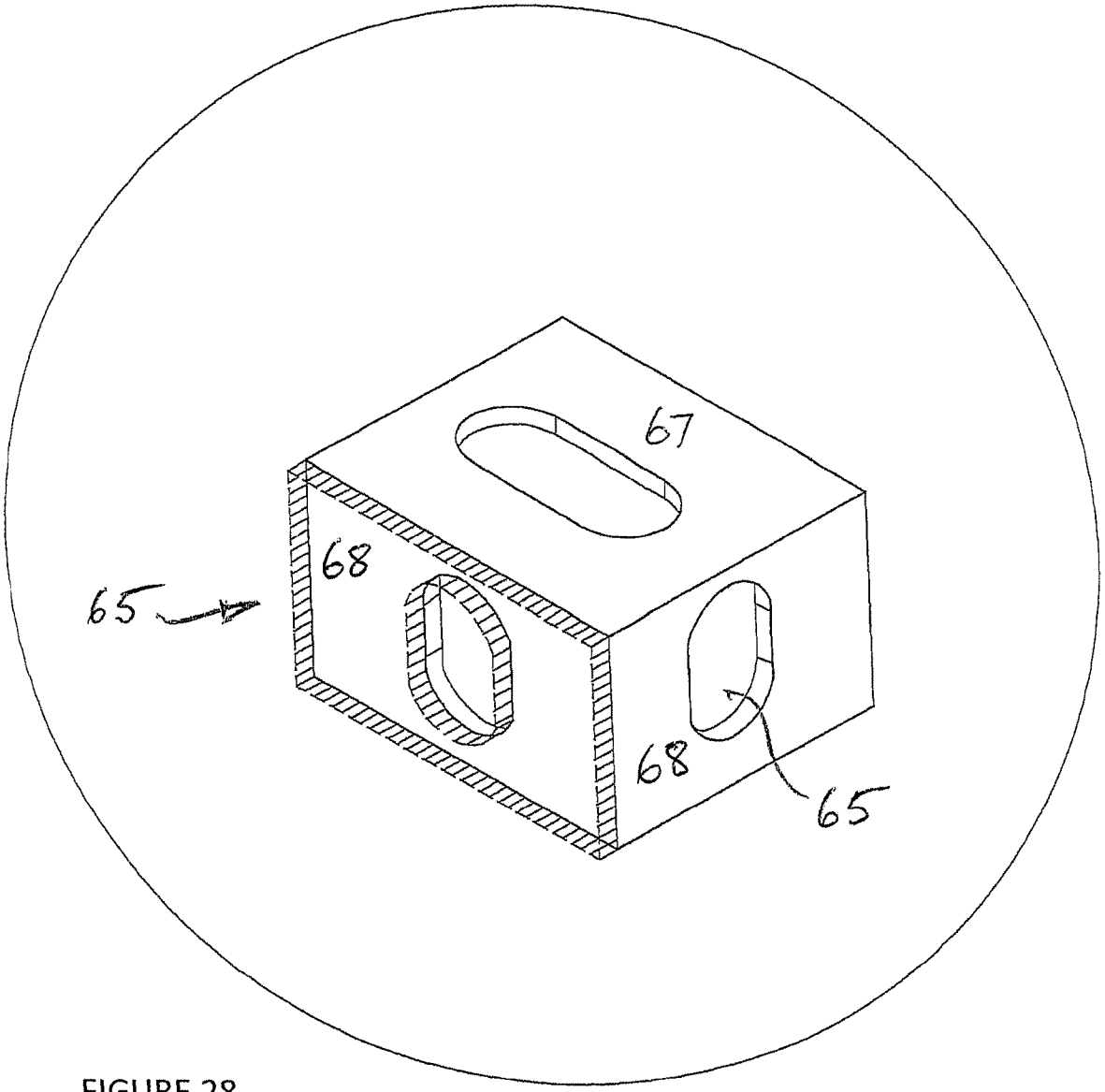
Figure 29:
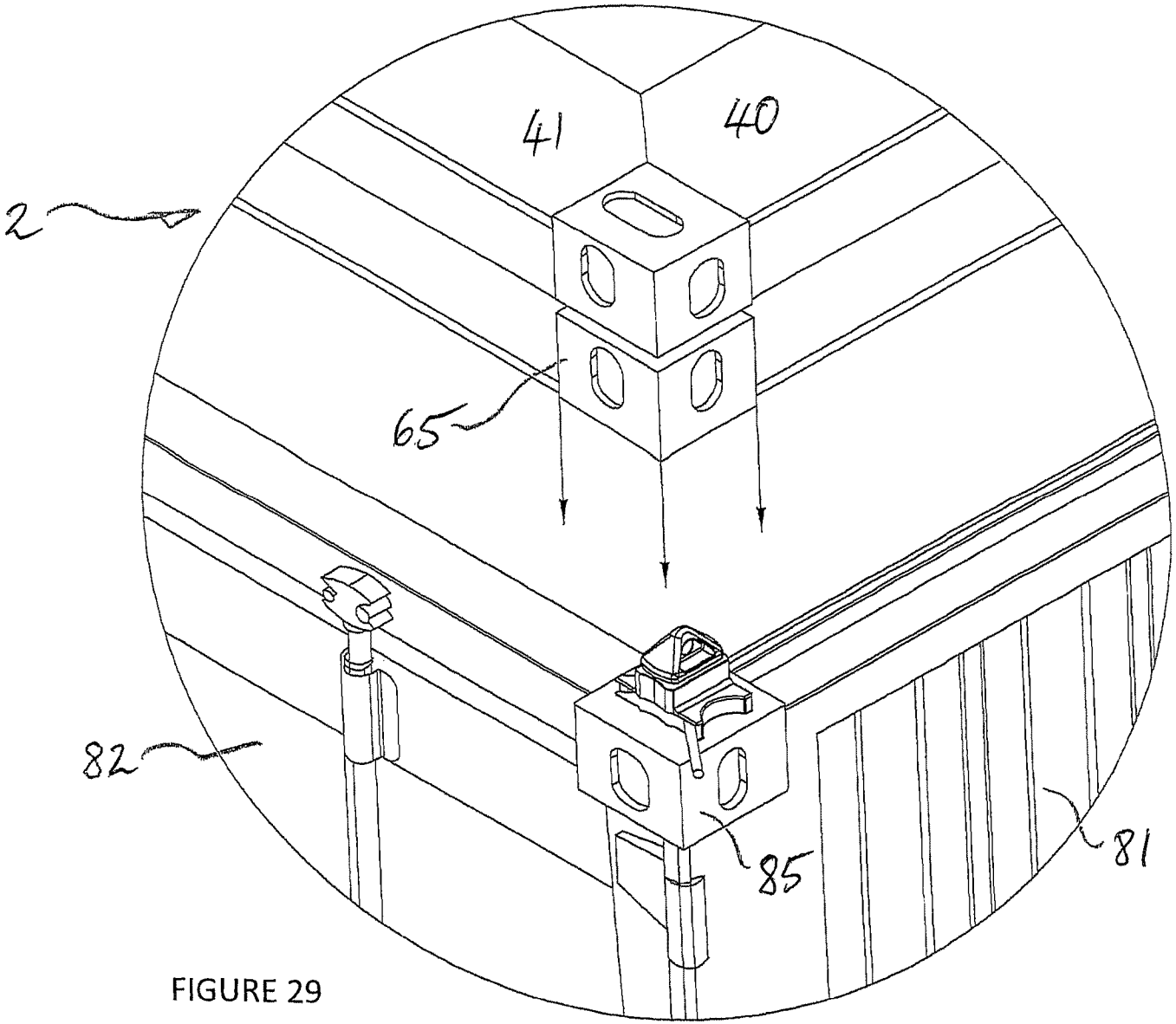
Figure 30:
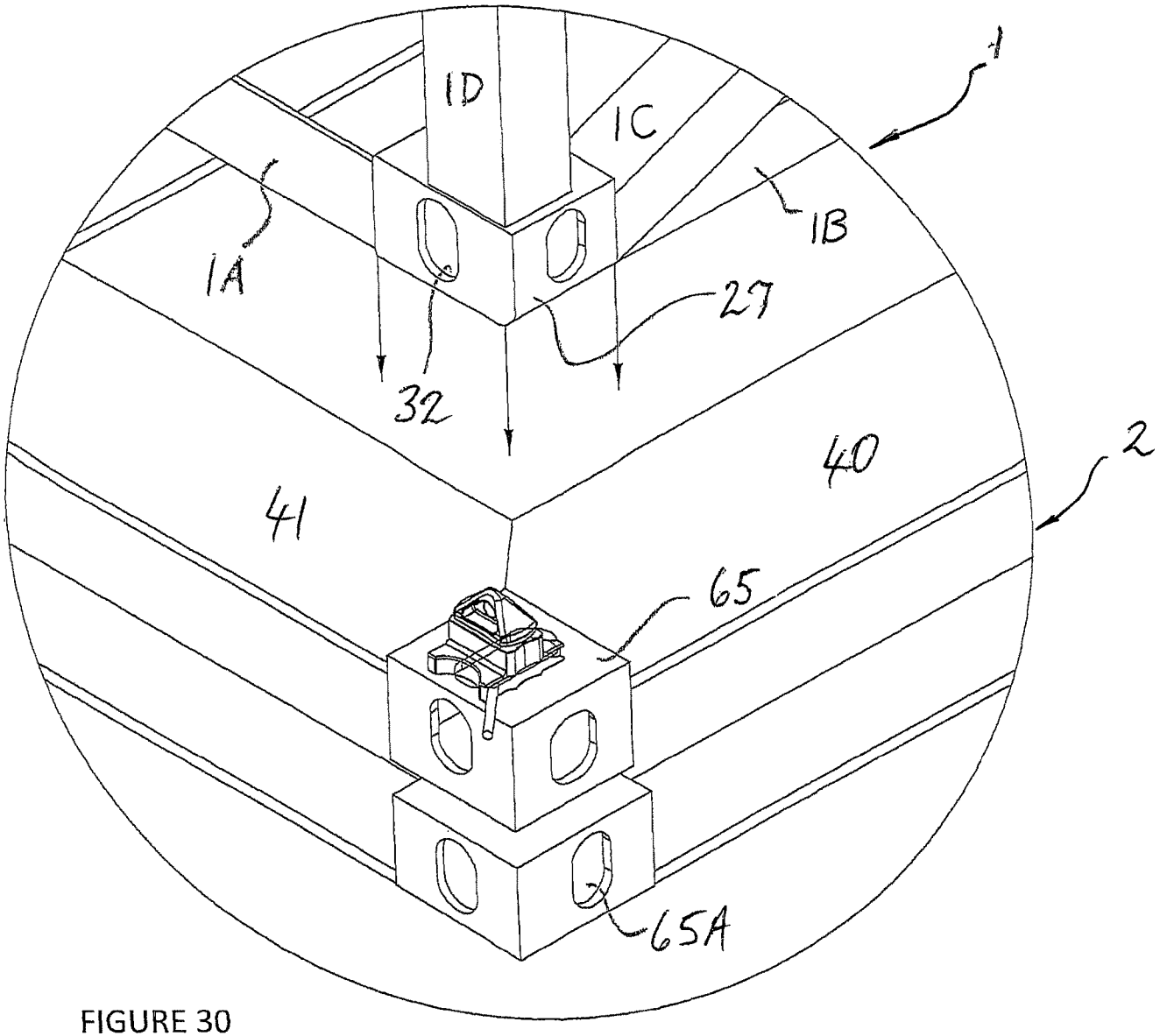
Figure 31:
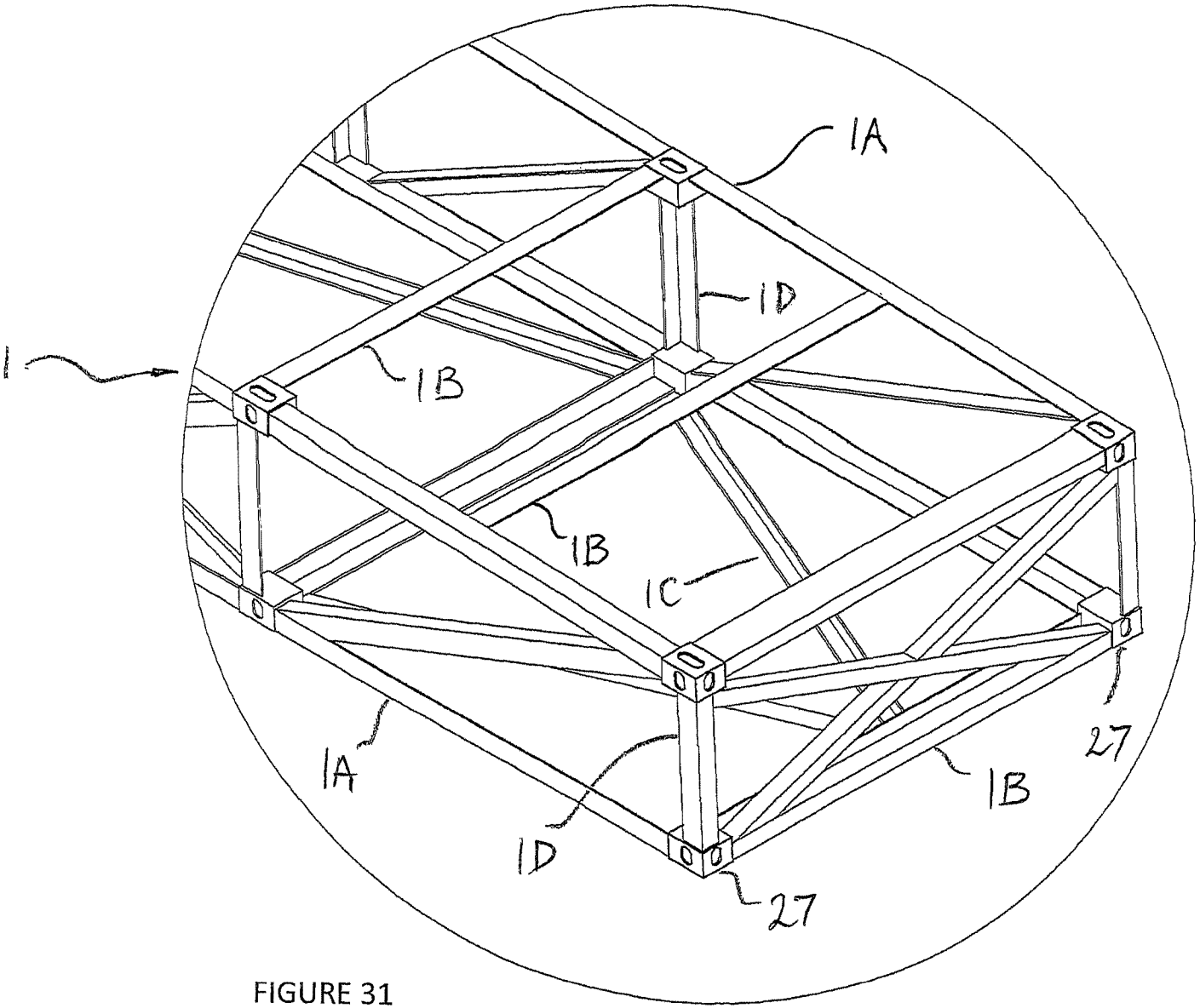
Figure 32:
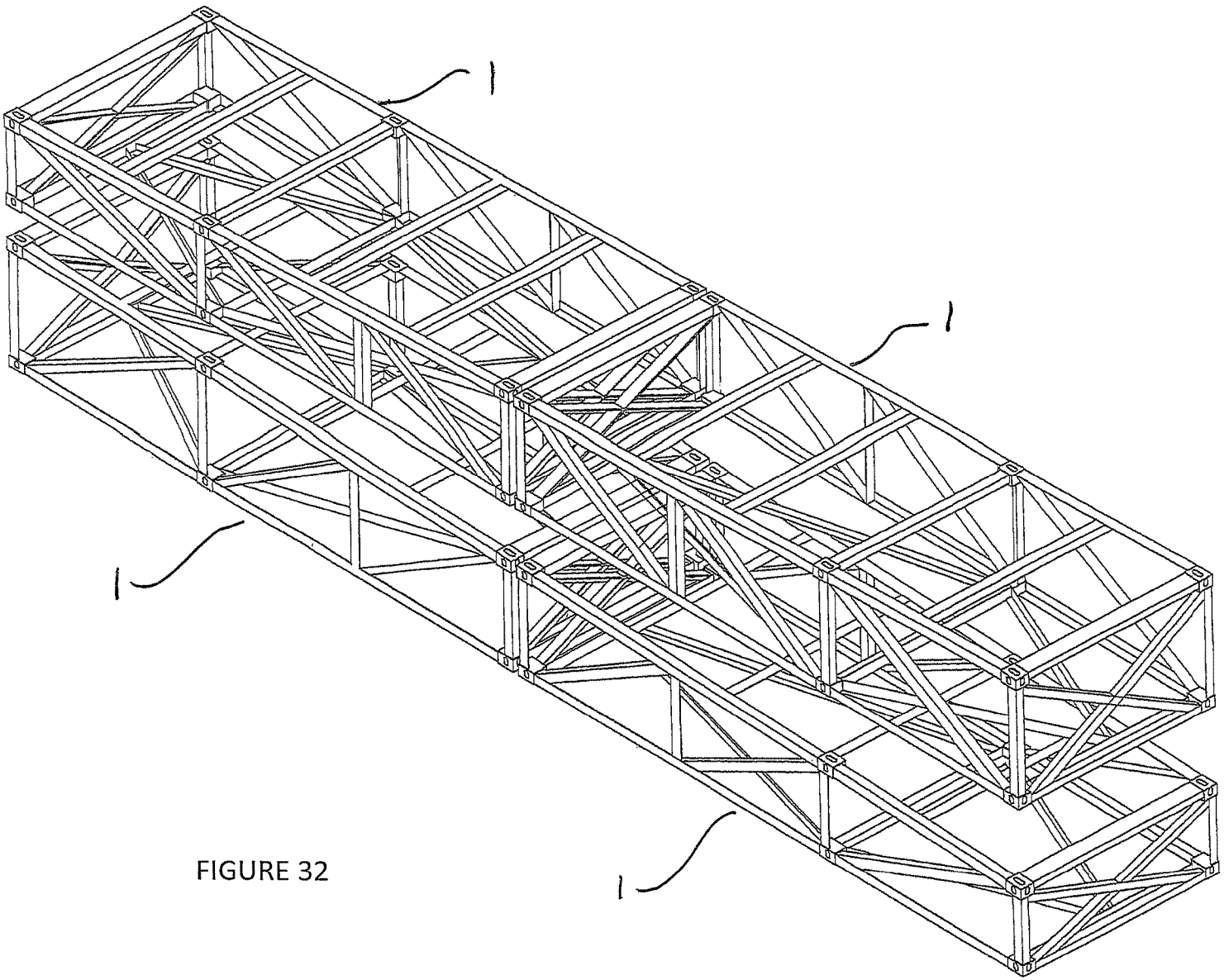
Figure 33:
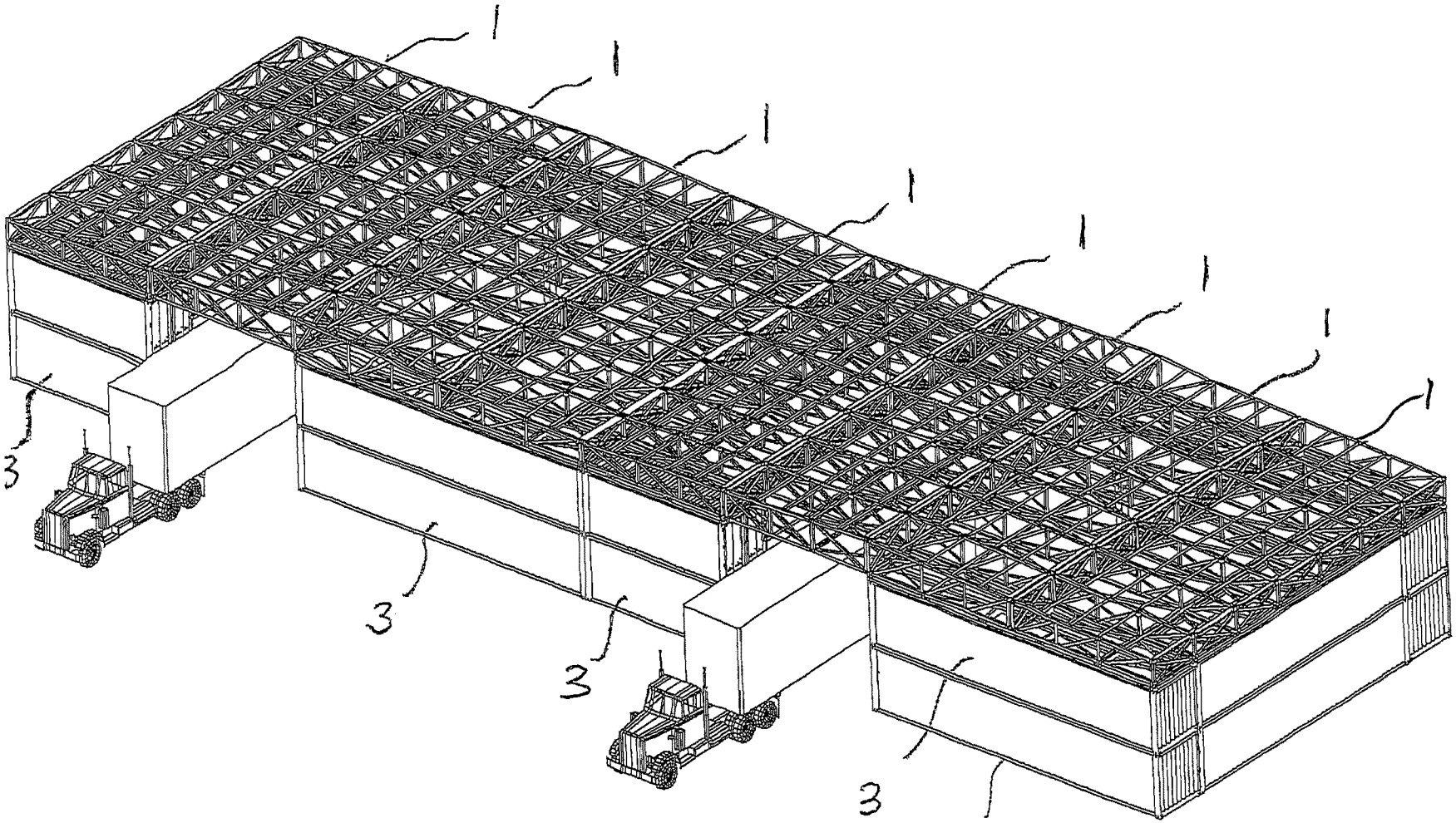

FIG. 7 is a perspective view of a typical corner casting without the twist lock assembly, FIG. 8 is a perspective view of an end portion or cell of the modular beam structure, FIG. 9 is a perspective view of the building structure comprising modular beam structure and modular based structure and 20 ft (6096 mm) shipping container, FIG. 10 is a perspective view of the modular beam structure for a 20 ft (6096 mm) shipping container, FIG. 11 is a perspective view of the modular base structure for a 20 ft (6096 mm) shipping container with an optional central longitudinal beam member, FIG. 12 is a perspective view of the 40 ft modular beam structure, 40 ft (12,192 mm) modular base structure and shipping containers, FIG. 13 is a perspective view of corner of the modular base structure about to be connected to a corner of a shipping container, FIG. 14 is a perspective view of the corner of the modular beam structure about to connect to the corner of the modular base structure, FIG. 15 is a corner view of the modular beam structure connecting to a non-corner of the modular base structure, FIG. 16 is a side view of upper and lower corner castings of the 40 ft (12,192 mm) modular base structure showing the twist lock assembly, FIG. 17 is a perspective view of upper and lower corner castings of the 40 ft (12,192 mm) modular base structure showing the twist lock assembly, FIG. 18 is a perspective view of an end portion or cell of the 40 ft (12,192 mm) modular beam structure showing the twist lock assembly, FIG. 19 is a perspective view of upper and lower corner castings of the modular base structure without the twist lock assembly, FIG. 20 is a perspective view of a portion of the 40 ft (12,192 mm) modular base structure, FIG. 21 is a perspective view of a building assembly utilizing the 40 ft (12,192 mm) modular beam structure, 40 ft modular base structure and shipping containers as wall structures, FIG. 22 is a perspective view of two 40 ft (12,192 mm) modular beam structures connected together to span the spanning distance between containers, FIG. 23 is a perspective view of one modular base structure, FIG. 24 is a side view of an upper casting with twist lock of a 40 ft (12,192 mm) shipping container and a lower corner casting of the modular base structure showing the twist lock assembly in between castings, FIG. 25 is a perspective view of the same components of FIG. 24, FIG. 26 is a perspective close up view of the corner of the modular beam structure about to connect to the non-corner castings of the modular base structure showing the twist lock assembly, FIG. 27 is a close up perspective view of a middle of the 40 ft (12,192 mm) modular base structure, FIG. 28 is a close up perspective view of a upper or lower corner castings of the modular beam structure and modular base structure without the twist lock assembly, FIG. 29 is a close up prospective view of the lower corner of the modular base structure about to connect to a corner castings of the shipping containing having a twist lock assembly, FIG. 30 is a perspective view of the corner of the modular beam structure about to connect to a corner of a 40 ft (12,192 mm) modular base structure with the corner casting showing the twist lock assembly, FIG. 31 is a close up perspective view of an end portion or end cell of the 40 ft (12,192 mm) modular beam structure, FIG. 32 is a perspective view of the storage or transport of 40 ft (12,192 mm) modular beam structures which are end connected and positioned onto of each other, FIG. 33 is a perspective view of a building utilizing both 20 ft (6096 mm) and 40 ft (12,192 mm) shipping containers and modular beam structures and modular base structures.

Figure 34:
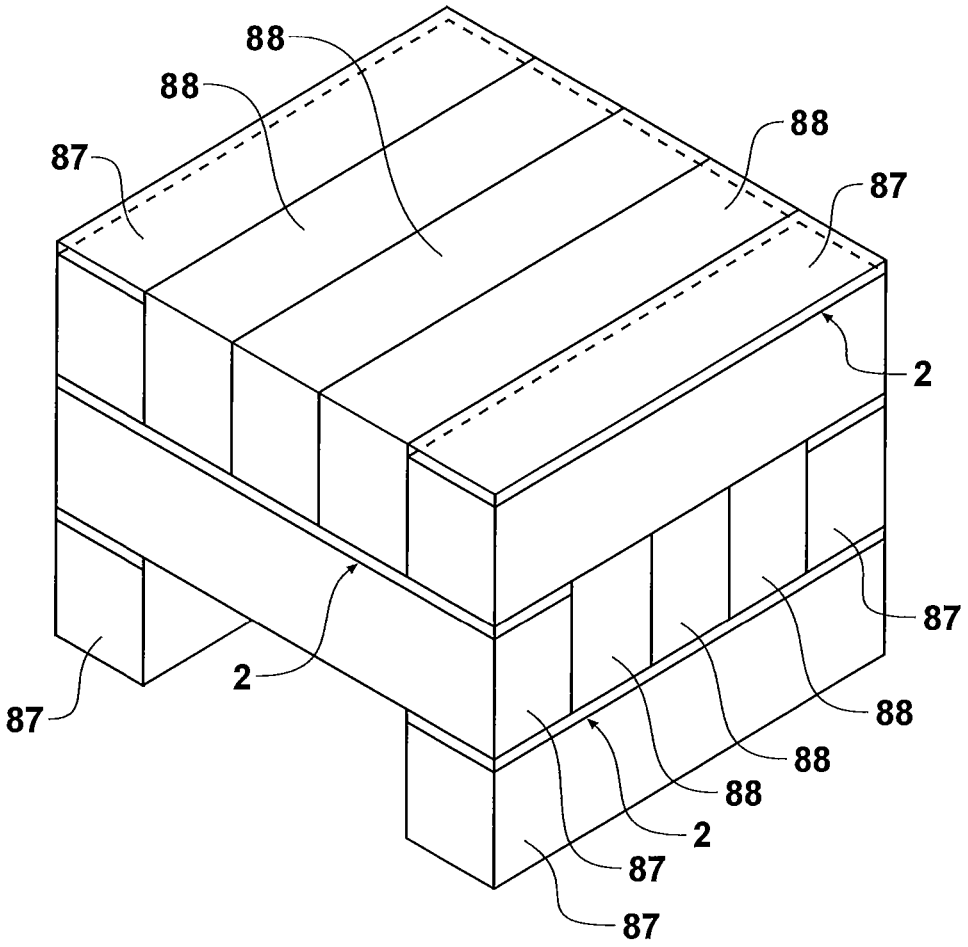

FIG. 34 is a schematic perspective view of an alternative roof structure which utilizes different height shipping containers (8.6 ft and 9.6 ft) with modular base structures to bridge the gap between the different heights of the containers.

Figure 35:
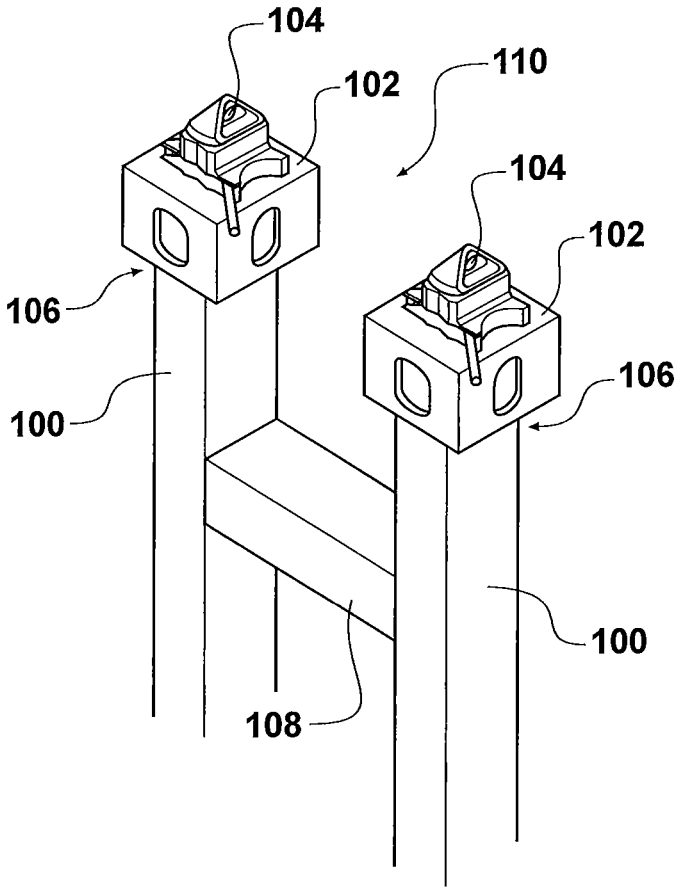

FIG. 35 is a schematic perspective view of the structural support including posts with bracing The following description will describe the invention in relation to preferred embodiments of the invention as shown in FIGS. 1-34, namely including the following components of a modular beam structure 1 and modular base structure 2 for a building structure 3 and a building structure assembly comprising at least one modular beam structure 1, at least one modular base structure 2 and at least one structural support which includes for example a shipping container or wall support.

For example the shipping or transport container includes a box like structure with side walls defining a width, end walls defining a length, floor to roof or top defining a height, the structural support can also include simply a wall support which can include for example posts or wall frame. The modular base structure is supported and adjustably connected directly by its corners on the structural support, e.g., on a shipping container. At least one modular beam structure is designed to span a distance between structural support which such modular beam structures also have a length, width and height which can be used as a spanning member or for example a roof truss which are supported by shipping container corner castings without loading the container walls. The modular beam structures are sized and dimensioned to be able to be stored or transported on top of each other or overlap or 'piggyback' and fit within a conventional shipping container and also sized and dimensioned to allow total coverage in a side by side orientation and by end supported on a shipping container.

The components of the present invention which are standardized to allow both easy assembly and easy disassembly and also easy transportation, using the shipping containers to carry most or at least part of the components.

The modular base structures 2 are sized and dimensioned to cover and be supportively connected only to the shipping container corner castings and at the same time connect and support at least an end portion of at least one modular beam structure 1 in a side by side configuration thereon. The modular base structures 2 are sized to be similar to a roof or base of a shipping container, thereby allow convenient transport within shipping containers or packed on top of or under a shipping container.

The modular base structure 2 supports at least an end portion of at least one modular beam structure 1 and each modular beam structure 1 is for use in spanning a distance between the structural support (shipping containers which act as one form of the structural support).

The modular beam member spans between the shipping container and a wall support or another shipping container, by being connectively supported at each end and at, at least one end by one modular base structure 2 connected to the top the shipping container which functions as a wall support for the modular base structure and at an end of the modular beam structure whereby the components of the present invention are standardized in shape and structure to allow easy and straightforward assembly and disassembly in relation to any sized shipping container and also in relation to transportation, using the shipping containers to carry most or at least part of the components of the present invention.

The invention is in no way limited to these preferred embodiments, as they are purely to exemplify the invention only and that possible variations and modifications would be readily apparent without departing from the scope of the invention.

Modular Beam Structure 1

Each modular beam structure 1 includes an elongate lattice space truss frame structure forming a substantially rectangular tubular box like structure having the following faces of: end faces 6, a top face 7, a bottom face 8, front side face 9 and rear side face 10 with a space 11 therein semi enclosed. The front side 9 and rear sides 10 are less in area than the top 7 and bottom 8 with the ends 6 being the smallest area. Though the term rectangular is used this does not necessarily mean that the structure is uniform in that an upper surface is sloped or angled for use as part of a roof structure.

The rectangular structure includes elongate members (first elongate members) comprising longitudinal beam members 1A, transverse cross beam members 1B, diagonal beam members 1C and upright members 1D connected together. The longitudinal beam members define a length and the transverse beams define a width such that the length and width of the rectangular structure is a multiple of the length of the wall support. The diagonal members are interconnected at the joints of the ends of the transverse beam members and longitudinal beam members.

The space truss frame structure is formed by interconnected elongate members having an L-shaped or angle cross section which such members can be oriented at right angles or at an angles or be conjoined to each other to form a certain pattern on each face of the space truss frame structure. In this example front 9 and rear sides 10 can be formed of a spaced rectangular or polygonal 4, side frames and the top 7 can be formed as regular rectangular frames. The bottom 8 can include regular rectangular frames with diagonal bracing members. Each end 6 of the frame structure can be formed of a rectangular frame with at least one diagonally oriented member.

The space truss frame structure of the tubular box like structure is made up of interconnected upper planar frame 13 and a lower planar frame 14 whereby the lower planar frame is oriented in substantially in a horizontal plane and the upper planar frame is oriented at an angle to the horizontal plane but which is closer to being horizontal than vertical. The upper and lower planar frames 13, 14 are separated by vertical oriented frames 15 of diminishing height 16, together forming the box like structure with an inner space 11 therein, and upper corners 17, lower corners 18 and intersections 19 between the elongate members.

The distance between the ends 6 (from outside of castings) defines an outside length and longitudinal direction 20 forming a longitudinal direction and a distance between front side and rear side define an outside width 21 (outside of casting to outside of casting) there between forming a transverse direction. The L-shaped cross section includes an upright portion 23 and base portion 24 whereby in use in this example the base portion 24 is orient at the bottom while the upright portion 23 is oriented upright but the L shape faces inwardly of the box like structure.

The tubular box like structure is subdivided into several rectangular box cells 26 having certain distance as a proportion of the total outside length 20 and outside width 21.

Corner casting assemblies are commonly provided at all external corners of transport containers. The corner casting assembly typically includes plate like box shape with horizontal and vertical walls forming an internal or semi enclosed space therein, with the walls including apertures shaped and/or a twist lock assembly. The twist lock assembly includes an operating handle operatively connected to a protruding member. The handle is located outside of the box above horizontal walls and the protruding member is located within the space whereby operating the handle causes the protruding member to protrude or not to protrude through the apertures.

Located at the upper 17 and lower 18 corners of the modular beam structure 1, there is provided a corner casting 27 as seen in FIG. 6 (without a handle and protruding member) having first horizontal (upper) face 28 separated from a second horizontal (lower) face 29 by mutually opposite two vertical side faces 30 forming a corner recess 32 therein or there between. Each face includes at least one aperture 32 for receipt of a protruding member 27*b* as part of the twist lock assembly from the modular base structure as shown in FIG. 4. The twist lock assembly includes a handle member 27*c* which is operatively connected to the protruding member 27*b*.

Corner castings 27 are formed as separate members and are fitted over or as part of the corners of the modular beam structure 1 with the apertures cut through a flange of transverse cross bean or longitudinal beam members, but equally the corner of the modular beam structure can be formed with a corner gap to receive the corner casting therein.

The orientation of the first horizontal and second horizontal faces will swap depending on which corner is being referred to. Each face has at least one aperture there through so that first horizontal 28 and second horizontal face 29 each have an elongate slot 32 at mutually opposing directions to each other and the vertical side faces 30 have smaller elongate slots therein being vertical in orientation. Corner castings 27 are provided at each corners at, at least one end of the tubular box like structure that requires support from the modular base portion and wall support.

There are also provided non-corner castings 35 located at non-corners or intersections between any lengths of the elongate members ie the transverse cross beam members and longitudinal beam members. Non-corner castings 35 are channel-shaped plate members having an upper horizontal face 36, vertical side face 37 and lower horizontal face 38 with each face having an aperture 39 there through which are in oriented opposite directions. Non-corner castings 35 are provided at a lower and upper portions of the tubular box like structure and in use engage with an upwardly protruding twist lock from a lower, corner casting and non-corner casting from the modular base structure 2.

Non-corner castings 35 are formed as separate members and are fitted over the or at the ends of the transverse cross members of the modular beam member 1 with the apertures cut through a flange of transverse cross beam and/or longitudinal beam members, but equally the ends can be formed with a gap to receive the non-corner casting 35.

As shown in the figures for the modular beam structure, none of the upper and lower corner castings and non-corner castings have a twist lock assembly though in other options twist locks can be included. Twist lock assemblies are provided in the upper corner casting 27 and non-corner castings 35 in the modular base structure. The twist locks provide a means for locking and connecting the corner castings and associate structure together for simple and quick assembly or disassembly.

The space frame structure of the modular beam structure 1, can be sized depending on the spanning distance between wall supports and/or the size of wall support ie if the wall support is a 20 ft (6059 mm) or a 40 ft (12032) shipping container. If the spanning distance is greater than a certain dimension then at least one other modular beam structure 1 can be end to end connected as required. The dimensions of the modular beam structure 1 can be selected to be sized to allow overlapping or not with each other, to be transported within a shipping container or located on top of or below for storage or transport.

Modular Base Structure 2

As shown in the figures the modular base structure 2 is a planar shaped rectangular structure with interconnected elongate members (second elongate members) comprising longitudinal beam members 40 separated by transverse cross beam members 41, forming three main polygonal cells 42 (eg rectangular or square between outer longitudinal beam members and end transverse cross beam members having a portion of an optional central longitudinal beam member as shown in FIG. 11) there between, having two equal spacing width 43 and one smaller spacing width (eg half of each of the other two) 43*a* with the modular base structure 2 designed to in use be oriented substantially horizontally. The longitudinal beam members 40 define a length and the transverse beam members 41 define a width of the modular base structure 2 such that the length and width of the rectangular structure is a certain multiple of the length of the wall support 3.

The modular base structure 2 is designed to be supported by corner castings of the wall support without loading the walls of the walls support. The modular base structure 2 is used to connect and provide a base for the modular beam structure 1 and/or can be used to make up a difference in height of short shipping containers.

The modular base structure 2 includes an elongate lattice space frame structure forming a single planar like structure having the following edge faces of: end faces 45, top face 46, bottom face 47, front side edge face 48 and, rear side edge face 49 whereby a planar area of the top 46 is similar in planar area to the bottom face 47. The outside length 50 is defined as being from end 45 to end 45 (outside of castings) and an outside width 51 is defined as being from side edge 48 to side edge 48.

A depth dimension 52 of the modular base structure is defined as extending from the top 46 to the bottom 47 at the castings which will be much less in dimension than the width 51 and length 50.

In this example, the elongate lattice space frame of the modular base structure 2 is formed comprising joined or connected elongate members comprising longitudinal beam members 40 including an I-beam or universal beam cross section with flanges 40*a* separated by a web 40*b* and transverse cross beam members 41 include a channel cross section having side walls 53 and base wall 54 and channel recess 55 there between whereby the channel cross section is oriented on its side with side walls 53 oriented horizontally and the base wall 54 being vertical with the channel recess 55 being oriented outward facing.

The space frame of the modular base structure 2 has at least one cell 42 including an inner bisected space 58 located in between the joined or connected elongate members. The space frame also comprises in use upper corner portion 60 and an adjacent lower corner portion 61 at each corner and intersections 63 at the ends of each cell 42 of the elongate members in the same plane or at various angles. Each upper corner portion 60 and lower corner portion 61 have a corner casting 65 therein with just an upper or lower horizontal face 67 and mutually opposing vertical side faces 68 with each face having an aperture shaped as an elongate slot 65A. As shown in FIG. 28 face 68 can for example have dimensions of 178×178 mm and face 67 can have for example area dimensions of say 154.5×178 mm a plate thickness of 4 mm. Therefore each outside corner of the modular base structure 2 includes an upper and lower corner castings and each intersection has abutting non-corner castings.

However each intersection 63 has two side abutting non-corner castings 70, 71 in the shape of channel-shaped castings with a horizontal (top or bottom) face 73 and a vertical side face 74. Two side abutting non corner castings are provided to allow for each end of a module beam structure to be connected to the modular base structure in a side to side abutting relationship. Again, similar to the corner castings 65 and non-corner castings 70, 71 of the modular beam structure 1, if the corner castings 65 of the modular beam structure are located on a top corner, then there are top faces whereas if the corner casting is located on a bottom corner, there will be bottom faces.

Each corner casting 27 and non-corner casting 35 of the modular beam structure 1 and corner casting 65 & non corner casting 70, 71 of the modular base structure 2, provide internal space or recess accessible by each aperture and/or include a twist lock assembly in each. Each twist lock assembly works in the standard way to having rotatable handle lever type member to twist a vertically protruding member through an adjoining aperture to lock or connect the protruding member in place to hold and connect various components together.

As shown in FIGS. 3 and 4 for the modular base structure 2, only the upper corner castings 65 and non-corner castings 70, 71 have the twist lock assembly.

Each shipping container 3 has a box like structure with side walls 81, end walls 82, base 83 and roof 84. As is customary with such shipping containers 3, each shipping container 3 is a rectangular shaped container with corner castings 85 and twist lock assemblies on all in use upper corners but with lower corner castings not having a twist lock assembly.

The modular base structure for the 20 ft (6096 mm) shipping container (see FIG. 11) can include three cells with the first two cells 42 being equal in width to the width of one modular beam structure 1 and the last cell 42 being half the width of the first two cells and modular beam structure 1. When two 20 ft (6096 mm) modular beam structures 1 are end abutting as shown in FIG. 9 then one modular beam structure can straddle two abutting half cells to be connected to the modular base structure.

In contrast, the modular base structure 2 for the 40 ft (12,192 mm) shipping container (see FIG. 23) can include six cells with the middle cells being two half cells across the length but bisected by a middle longitudinal beam member 40, with four outer cells and two half middle cells each being equal in width to the width of the modular beam structure 1. When modular beam structures 1 as shown in FIG. 23 are side abutting, then one modular beam structure in the middle can straddle the two middle abutting half cells to be connected to the modular base structure 2.

In both of these modular base structures the longitudinal beam members 40 are continuous in length with the transverse cross beam members 41 extending between.

Height Variation of Shipping Containers—Shaving Corner Castings—Length and Width Variations of Shipping Containers As shown in FIG. 34 the depth 52 of the modular base structure 2 can be used to allow for a difference in height of shipping containers 3 such as between short height shipping container 87 ie 8.6 ft (2591 mm) and a tall height shipping container 3 eg 9.6 ft (2896 mm) containers which gives a difference of 2896−2591=305 mm at the corner castings The modular base structure 2 has a depth 52 (upper surface of upper casting 65 to lower surface of lower casting 65) as 275 mm. When the modular base structure 2 is sitting on top of the top of a shipping container 3 i.e., casting to casting, there will be a gap G eg of 30 mm which is created by the twist lock—see FIG. 24. There is also an allowance made for the casting of the container to protrude upwardly beyond the roof the container as dimension 87 which can typically be about 10 mm. This means that the depth 52 of the modular base structure 2 allows for the difference in height, making the top of the modular base structure 2 level with the top (the top being top of the castings or roof) of an abutting tall shipping container.

The standard outside length X width dimensions of a standard ISO shipping container are L12192 mm×W2468 mm. The center to center slot length X width dimensions are L1185 mm×W2259 mm. For the outside length dimension of 12,192 we can accommodate five modular beam structure 1 side to side on one modular base structure on one shipping container. Therefore the length 21 of one modular beam structure 1 is set at 12,192 mm outside of corner casting and the length of one modular base structure 2 is set to 12,192 mm which is subdivided by 5 spaces for 5 sides (side faces 9, 10) abutting modular beam structure 1 ie the width 21 (outside of casting to outside of casting) of each modular beam structure 1 will be 12,192 mm/5=2438 mm—8 mm for an allowance of uneven dimensions of the castings.

The length of the modular base structure 2 is sized to allow for most standard variations in container lengths and widths and for the dimensions and positions of the corner castings. One 40 ft (12,192 mm) length modular base structure 2 is sized to also receive two 20 ft (6096 mm) lengths of modular base structures 2. Additionally one 40 ft (12,192 mm) modular beam structure or two 20 ft (6096 mm) modular beam structures 1 can be used as five abutting structures along the length of one 40 ft (12,192 mm) or two 20 ft (6096 mm) modular base structures 2, on one 40 ft (12,192 mm) shipping container 3 or two 20 ft (6096 mm) shipping containers 3.

Some standard shaving of the sides of the casting of the shipping container can be combined with the allowance in size variations for the spacing of casting supports in the modular base structure 2, from outer surface of castings to outer surface of castings.

Assembly

A method of assembly of a building structure utilizing the following components of a shipping container, a modular base structure 2 and/or modular beam structure 1 of the present invention includes the steps of;

- Arrange suitable wall supports in the form of shipping containers to form the walls of a proposed building structure being positioned to be spaced apart forming a roof spanning distance there between;
- Place modular base structures onto the top of the shipping containers;
- Operate handle of the twist lock assembly of the shipping container to lock the modular base structure to the shipping container;
- Position an end portion of each modular beam structure onto the top of a base structure;
- Operate twist lock assemblies in upper portion of the modular base structure to lock a lower casting of the modular beam structure to the modular base structure;
- Repeat process for locking in as many modular beam structures to completely cover the modular base structure 2 and shipping container to form one side of the spanning distance between the shipping containers;
- Repeat process for other side of span;
- For spanning distances larger than the length of one module beam structure, bolt the ends of an opposing modular beam structure to another modular beam structure to finish at a central span position;
- Bolt the ends of each opposing modular beam structure at a central span position to form a roof support;
- Cover the roof support with any suitable covering.

To form a building, the following standardized components include at least one shipping container 3 which can be used to form a wall of such a building structure whereby at least one modular beam structure is used to form at least part of a roof structure supported by a top of the walls or shipping containers.

The modular base structures 2 are used as a base for connecting underneath an end portion 86 (eg one box like cell 26) of at least one modular beam structure 1. The modular base structure 2 is located, connected or locked and supported on a roof 84 of the shipping container 20.

In a proposed building, the shipping containers 80 form the walls by having the shipping containers 80 positioned in parallel but spaced orientation from each other, forming a spanning distance 86 from side wall 81 to side wall 81.

As shown in the figures each modular base structure 2 includes a standard set of cells 42 which space the transverse beam members 41 and non-corner castings 70, 71 appropriately to receive an end of each modular beam structure. As shown in the figures the end portion of each modular beam structure 1 is resting a complete width 51 of the modular base structure to cause a major proportion of the length to be cantilever therefrom and spanning a half the spanning distance 86.

An outside area of the modular base structure 2 is similar to an upper outside area of the shipping container to allow the interconnection between twist locks and apertures to connect and locate all of the modular base structure 2 on the top of the shipping container.

The outside width 21 of the modular beam structure 1 is sized to match the space width 43 of each cell of the modular base structure 2 which operatively allows the corner castings of the end of the end portion of one modular beam structure to inter-fit with the corner castings 65 and non-corner castings 70, 71 to allow several abutting modular beam structures to be supported to form at least part of a roof structure.

As shown in FIG. 5, the height 15*a* of the modular beam structure 1 is higher at one end than the other so that the higher end is located in the center of a spanned distance between shipping containers 80 and the lower end of each modular beam structure 1 is located and connected to the modular base structure 2 or shipping container. To form the rest of the roof of the building a mirror image of one side is also erected.

Because the length 21 of the modular beam structure 1 is the set to be the same length as length of the modular base structure 2 and the shipping container 80 one can fit these inside a shipping container or because the height diminishes for the modular beam structure if one were to place two beam structures 2 in opposite overlapped orientations to fit the total height of the container or even allow easier transport.

Variations

Aspects of the present invention have been described by way of example only and it should be appreciated that modifications and additions may be made thereto without departing from the scope thereof. Though shipping container lengths of 20 ft (6096 mm) and 40 ft (12,192 mm) are mentioned in this specification, there are only examples and any other length or width or height dimensions are equally possible with the principle of the modular beam structure and modular base structures of the present invention to build a structure.

The modular beam structure can optionally be used as structural beams to span any suitable distances such as to form a bridge structure. Though angle, channel and I-beams or universal beams are used for the various elongate members, equally other cross sections or combinations of cross sections, are equally possible depending on structural and physical requirements. The particular shape of each beam or base structure can be varied by including more cells or more verticals or more cross members or bracing. The cross sections of the modular beam structures or modular base structures can also be varied to suit particular aesthetics or structural requirements.

The interconnected elongate members of the modular beam structure 1 can be connected or joined by a variety of methods such as by welding or bolting or any combination thereof. Furthermore the interconnected elongate members can be formed from any suitable material that is able to be joined or connected and provide appropriate structure strength and functionality as required. Extra castings or supports can be added to further enhance the structural integrity of the modular base structure with placing any loadings on the walls of the shipping container.

The structural support includes any wall support comprising a frame including at least two posts 100 with corner castings 102 with twist lock assemblies 104 affixed to a top 106 of each post 100. The posts 100 can also optionally be interconnected together with cross bracing members 108 or be part of a wall frame 110.

Definitions

Throughout this specification the word "comprise" and variations of that word, such as "comprises" and "comprising", are not intended to exclude other additives, components, integers or steps.

Throughout this specification the term "shipping container or transport containers" is intended to refer to the standardized shipping containers in the form of standardized reusable steel boxes, that are commonly referred to as "containers", "intermodal containers", "freight containers", "ISO containers" or "hi-cube containers". These containers are used to store and move or transport materials and products in the global containerized intermodal freight transport system by road or by water.

These containers are sometimes referred to as "intermodal containers" since these containers can be moved from one mode of transport to another, i.e. from ship, to rail, to truck, without the need to unload and reload the contents of the containers. The length of these containers typically varies from 8 to 56 feet (2.438 to 17.069 m), with 20 feet and 40 feet long containers being most common. The heights vary from 8 feet (2.438 m) to 9 feet 6 inches (2.896 m), and the width is typically 8 feet (2.438 m).

"Structural support" can be a term to describe any form of support that includes a structure including at least, corner castings suitable to support and adjustably connect with the corner castings and/or twist lock assemblies of the modular base structure and modular beam structure. For example, the structural support includes any structure that is able to support the modular base structure and this includes shipping containers or their equivalents having posts or wall framing with twist locks at each corner to match the location of the corner castings of the modular base structure.

Optional Advantages

Thus it can be seen that at least a preferred form of the invention provides a modular beam structure, modular base structure and building structure which can be used in the construction of a temporary or permanent building structure relatively quickly and which can be transported as separate components relatively easily using conventional shipping and transportation methods. In summary some optional advantages of the present invention can include:

- Simple construction
- Simple and standard assembly
- Rapid assembly or Modest cost
- Readily transportable as components
- Modular base structures are similar in size to the roof or floor of shipping container so can be transported on top of or underneath shipping containers
- Modular beam structures can be overlapped with each other to form a volume similar in size to or less than, the inside of the shipping container so that can be easily transported within the shipping containers
- Shipping containers can be stacked as walls
- Modular base structures able to end support several modular beam structures, in a side by side orientation over the complete length of the shipping container
- Modular beam structures only are supported and adjustably connected by the modular base structure, between corner castings to corner castings.
- Modular base structure spans and adjustably connects between its corner castings and the corner castings of the shipping container
- Modular base structures able to be supported by corner castings only, of a shipping container
- Modular base structure can be sized to be used with any sized shipping container
- Modular base structure is sized with its own corner castings, to allow for most variations in the position and size of the corner castings and twist lock assemblies of the shipping containers.
- Shipping containers can be used as walls and roof structures
- Able to readily assembly and or disassemble
- Modular beam structure is able to form part of a roof structure
- Able to use most shipping containers as wall supports
- Depth of modular base structure allows for different height containers
- Able to overlap or 'piggyback' two modular beam structures inside a shipping container
- Modular beam structure able to be transported inside a shipping container
- Any suitable number of modular beam structures can be end connected to span the distance between structural supports (e.g., shipping containers)
- No loading by modular base structure and modular bean structure on walls of a shipping container Able to be used with any structure that have corner castings with twist lock assembles like for example shipping containers or posts as supports Loading only through corner castings.

I claim:

1. A building structure assembly comprising:

at least one modular beam structure; and at least two modular base structures, wherein each modular base structure is designed to be supported only by corners of a shipping container having a length, a width, and a height, the shipping container further having walls and corner casting assemblies, each of the corner casting assemblies having a twist lock assembly, wherein each modular base structure is designed to support an end portion of the at least one modular beam structure, wherein each modular beam structure is capable of spanning a distance between two of said shipping containers that are spaced apart from each other, wherein each modular beam structure includes corner castings located at each corner of the modular beam structure and non-corner castings located between each corner of the modular beam structure, with each corner casting and non-corner casting including slot apertures sized and oriented for locking receipt of part of the twist lock assembly of one of the modular base structures, wherein each modular beam structure includes an angled top portion and level bottom portion, the level bottom portion being oriented in a horizontal plane and the angled top portion being at a non-zero angle to the horizontal plane, each modular beam structure having a length, a width, and a height, such that the length and the width of the modular beam structure is sized to fit within a shipping container, wherein each modular beam structure is shaped and dimensioned to be able to be assembled on top of each other creating a shipping container size allowing transport within the shipping container, wherein each modular base structure includes a base having a length and a width corresponding to the length and width of the shipping container, each modular base structure designed to be located on and supported and connected to a top of the shipping container, wherein each modular base structure is connectable to the at least one end portion of the at least one modular beam structure when the modular base structure is supported by and adjustably connected to the corner casting assemblies of the shipping container without loading the walls of the shipping container, wherein corner castings of each modular base structure includes upper and lower corner castings with each upper corner casting including a twist lock assembly therein for locking connection to one of the corner castings of the at least one modular beam structure and the lower corner castings having slot apertures for locking receipt of the twist lock assembly of the shipping container, wherein the at least one modular beam structure can span between spaced apart shipping containers by being connectively supported at each end of the modular beam structure and at least one end by one modular base structure which in turn can be connected to the top of one of the shipping containers, and whereby the at least one modular beam structure and the at least two modular base structures are shaped and structured to allow assembly and disassembly in relation to the shipping containers and also transportation, using the shipping containers to carry components of the at least one modular beam structure and the at least two modular base structures.

2. The building structure assembly as claimed in claim 1 wherein each modular beam structure is configured as at least a part of a roofing beam.

3. The building structure assembly as claimed in claim 1, wherein, the width of the modular beam structure members is a precise portion length of the length of a standard 40 foot shipping container to allow side abutting over a 40 foot length made up of one 40 foot modular base structure or two abutting 20 foot base structures.

4. The building structure assembly as claimed in claim 1, wherein the modular base structure has a depth dimension defined as extending from an in use upper horizontal plane to a lower horizontal plane of the two upper and lower the corner castings and allows for the upward protrusion of the casting assemblies of one of the shipping containers to cause the modular beam structure to make up a difference in height between short and tall shipping containers and a distance between the corner castings of the modular base structure is a length dimension that accommodates variations in dimensions and positions of the corner casting assemblies of the one shipping container.

5. A method of building structures which include using the shipping containers and the building structure assembly of claim 1, the method including the steps of:

arranging the shipping containers to form wall supports of a building structure being spaced apart forming a roof support spanning a distance there between;

placing each of the modular base structures onto the top of a respective one of the shipping containers;

operating each twist lock assembly of the shipping containers to lock the modular base structures to the shipping containers;

positioning an end portion of each modular beam structure onto the top of one of the modular base structures;

operating each twist lock assembly in a lower portion of the modular beam structure to lock the beam structure to the modular base structure; and covering the roof support with a covering.

6. The building structure assembly as claimed in claim 1, each modular beam structure includes a lattice space truss frame structure comprising first longitudinal beam members, first transverse cross beam members and first diagonal beam members connected together, forming an elongate box framed rectangular structure with plural box cells with corners.

7. The building structure assembly as claimed in claim 6, wherein each modular base structure includes an elongate lattice space frame structure forming a single planar rectangular structure having faces, a top face, a bottom face, a front side edge face, and a rear side edge face, wherein each single planar rectangular structure comprises second elongate members including second longitudinal beam members and second transverse cross beam members connected together to form corners of the single planar rectangular structure and intersections between the second elongate members of the single planar rectangular structure.

8. The building structure assembly as claimed in claim 7, wherein second longitudinal beam members of the modular base structure define a length and the second transverse cross beam members of the modular base structure define a width such that the length of the single planar rectangular structure is a complete length of the length of the shipping container, and a width of the single planar structure is identical to a width of the shipping container.

9. The building structure assembly as claimed in claim 8, wherein the second longitudinal beam members comprise an I-beam cross section.

10. The building structure assembly as claimed in claim 7, wherein the modular base structure includes three spaced apart ones of the second longitudinal beam members connected with spaced apart ones of the second traverse cross beam members, and spacing of some of the second transverse cross beam members corresponds to the width of the modular beam structures.

11. The building structure assembly as claimed in claim 1, wherein the modular base structure has the upper non-corner castings arranged in pairs to accommodate the modular beam members when located in a side by side relationship on the modular base structure.

12. A building utilizing shipping containers as some or all of wall supports of the building, comprising:

a plurality of shipping containers, at least two of the shipping containers being spaced apart;

at least one modular beam structure; and at least two modular base structures, wherein, each modular base structure is designed to be and is supported only by the corners of one of the shipping containers, each modular beam structure is capable of spanning a distance between spaced apart ones of the shipping containers and connected to and supported at least one of the modular base structures, each modular beam structure has a length, a width, and a height, wherein each modular beam structure further comprises corner castings located at each corner and non-corner castings located between each corner, with each corner casting and non-corner casting including suitably sized and oriented slot apertures for locking receipt of a part of a twist lock assembly as provided by one of the modular base structures, wherein the modular beam structure includes an angled top portion and a level bottom portion which defines a length and a width such that the length of the modular beam structure corresponds to a length of the shipping containers and the modular beam structures being shaped and dimensioned to be able to be assembled on the top of each other creating a shipping container size allowing transport within the shipping containers, wherein each of the modular base structures provides a base located on and supported and connected to a top of one of the shipping containers, wherein the modular base structures are supported on and adjustably connected by corner castings of one of the shipping containers without loading walls of the shipping container, wherein each modular base structure includes an elongate lattice space frame structure forming a single planar rectangular structure having end faces, a top face, a bottom face, a front side edge face, and a rear side edge face, wherein the single planar rectangular structure has upper and lower corner castings located at each corner whereby the upper corner casting includes a twist lock assembly therein for locking connection to another corner casting of one of the modular beam structures and the lower corner castings have slot apertures for locking receipt of a twist lock assembly of one of the shipping containers, wherein the modular base structure includes non-corner upper castings, each non-corner upper casting having a twist lock assembly in an upper portion for locking receipt in slotted apertures of other corner castings of one of the modular beam structures, and a distance between one of the corners of the modular base structure and one of the non-corner upper casting of the modular base structure or between one of the non-corner upper casting of the modular base structure and another non-corner upper casting of the modular base structure being dimensioned to receive a width of another modular beam structure, and wherein each modular beam structure can span between the spaced apart shipping containers by being connectively supported at each end of the modular beam structure and at least one end by one modular base structure, which in turn is connected to the top of one of the shipping containers.

13. The building as claimed in claim 12, wherein a cross section of elongate members of the modular beam structure is an L shaped member.

14. The building as claimed in claim 12, wherein there are at least of the two modular beam structures and the modular beam structures are end to end connected in a middle of a span between spaced apart ones of the shipping containers to form a roofing beam, and opposing ends of the modular beam structures are supported by the modular base structures located and adjustably connected to the corner castings on top of each shipping container.

* * * * *